US007841958B2

(12) United States Patent
Fleming et al.

(10) Patent No.: US 7,841,958 B2
(45) Date of Patent: Nov. 30, 2010

(54) MODULAR TABLE TENNIS GAME

(75) Inventors: Matthew D. Fleming, Alexandria, VA (US); Daniel Lee Bizzell, Davidson, NC (US); Ian D. Kovacevich, Charlotte, NC (US); Juan Marin, Charlotte, NC (US); Ashley Beres Tilley, Matthews, NC (US); Kevin J. Dahlquist, Charlotte, NC (US); Carole Ruffin, Cleveland, OH (US); Chris Adams, Matthews, NC (US); Meredith Beck, Durham, NC (US)

(73) Assignee: Edison Nation, LLC, Charlotte, NC (US)

( * ) Notice: Subject to any disclaimer, the term of this patent is extended or adjusted under 35 U.S.C. 154(b) by 81 days.

(21) Appl. No.: 12/349,943

(22) Filed: Jan. 7, 2009

(65) Prior Publication Data

US 2009/0191987 A1 Jul. 30, 2009

Related U.S. Application Data

(60) Provisional application No. 61/019,587, filed on Jan. 7, 2008, provisional application No. 61/021,333, filed on Jan. 15, 2008.

(51) Int. Cl.
*A63B 67/04* (2006.01)

(52) U.S. Cl. ..... 473/496

(58) Field of Classification Search ..... 473/496
See application file for complete search history.

(56) References Cited

U.S. PATENT DOCUMENTS

| | | | | | |
|---|---|---|---|---|---|
| 2,313,701 | A | * | 3/1943 | White | 473/475 |
| 2,911,217 | A | * | 11/1959 | Block | 473/435 |
| 3,622,156 | A | * | 11/1971 | Pugsley | 473/496 |
| 3,777,674 | A | * | 12/1973 | Parsons | 108/175 |
| 4,334,681 | A | | 6/1982 | Scheie | |
| 4,765,619 | A | * | 8/1988 | Cooper | 473/496 |
| 4,772,018 | A | | 9/1988 | Inniger | |
| 5,460,365 | A | * | 10/1995 | Payne | 473/494 |
| 5,575,471 | A | * | 11/1996 | Robinson et al. | 473/475 |
| 6,007,438 | A | | 12/1999 | Harrell | |
| 6,155,939 | A | * | 12/2000 | Takacs | 473/496 |
| 6,379,273 | B1 | * | 4/2002 | Takacs | 473/496 |
| 6,645,096 | B1 | * | 11/2003 | Nally et al. | 473/496 |

FOREIGN PATENT DOCUMENTS

| | | | | |
|---|---|---|---|---|
| DE | 3519745 | A1 | * | 12/1986 |
| JP | 2001129140 | A | * | 5/2001 |
| JP | 2002301178 | A | * | 10/2002 |
| JP | 2006204675 | A | * | 8/2006 |
| WO | WO 8300095 | A1 | * | 1/1983 |

* cited by examiner

*Primary Examiner*—Raleigh W. Chiu
(74) *Attorney, Agent, or Firm*—James D. Wright; Chad D. Tillman; Tillman Wright, PLLC

(57) ABSTRACT

A modular table tennis game includes a plurality of paddles, a table tennis ball, and an adjustable table, or multiple adjustable tables. The tables may be mounted on a support system such as a tripod or other support structure that allows the tables to be adjusted in height and tilt. The top of the tables may have an opening or openings larger than the table tennis ball penetrating therethrough.

20 Claims, 25 Drawing Sheets

MODULAR TABLE TENNIS GAME

CROSS-REFERENCE TO RELATED APPLICATION

The present application is a U.S. nonprovisional patent application of, and claims priority under 35 U.S.C. §119(e) to, U.S. provisional patent application Ser. No. 61/019,587, filed Jan. 7, 2008, and U.S. provisional patent application Ser. No. 61/021,333, filed Jan. 15, 2008. Each of the foregoing provisional patent applications is incorporated by reference herein.

COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE PRESENT INVENTION

1. Field of the Present Invention

The present invention relates generally to a free standing table-type game of skill using a ball and paddles that is a variation on table tennis, and, in particular, to a free standing table-type game of skill wherein one or more table modules may be used to play the game.

2. Background

A typical table tennis game uses a table that is nine feet long, five feet wide, and thirty inches high. These dimensions are a standard set by the International Table Tennis Federation. A standard table requires considerable space, and therefore limits the appeal of the game for those without adequate space.

A need exists for improvement in the field of table tennis that addresses the space constraints as well as allowing new and creative variations on the game to be played. This, and other needs, are addressed by one or more aspects of the present invention.

SUMMARY OF THE PRESENT INVENTION

The present invention includes many aspects and features. Moreover, while many aspects and features relate to, and are described in, the context of table tennis, the present invention is not limited to replicating regulation-type table tennis games, as will become apparent from the following summaries and detailed descriptions of aspects, features, and one or more embodiments of the present invention.

The present invention according to a first aspect is a modular table tennis game set including a plurality of paddles; a table tennis ball; a plurality of table modules, each having a top member having a playing surface, and a support system, on which the top member is mounted, providing an adjustable height for at least a portion of the top member.

In a feature of this aspect, each of the plurality of table modules is separated from at least one other table module by a substantial distance.

In a further feature of this aspect, the distance the plurality of table modules is at least as great as a substantial fraction of the length or width of the top member.

In a further feature of this aspect, the distance is at least 2.25 feet.

In a further feature of this aspect, every one of the plurality of table modules separated from all other table modules by a substantial distance.

In a further feature of this aspect, the support system includes an adjustable-height tripod.

In a further feature of this aspect, the tripod is mounted to the top member at a location substantially adjacent the center of a bottom surface of the top member.

In a further feature of this aspect, the top member is mounted to a tripod via an adjustable mounting assembly having a first part connected to a top of the tripod and a second part connected to the top member, wherein the second part is rotatable, relative to the first part, about an axis of rotation.

In a further feature of this aspect, the support system has a plurality of legs of adjustable length.

In a further feature of this aspect, the top member is mounted to the legs at substantially separated locations on the bottom surface of the top member.

In a further feature of this aspect, the plurality of legs has exactly three legs.

In a further feature of this aspect, the top member is adapted to be tilted by adjusting the length of a first of the plurality of legs to e different than the length of a second of the plurality of legs.

In a further feature of this aspect, the top member of at least one table module has a playing surface that is tilted at a substantially non-vertical angle relative to horizontal.

In a further feature of this aspect, the playing surface of each top member has an opening, penetrating therethrough, with a diameter that is substantially greater than the diameter of the table tennis ball.

The present invention according to a second aspect is a modular table tennis game set including a plurality of paddles; a table tennis ball; and a plurality of table modules, each including a top member having a playing surface with an opening, having a diameter that is substantially greater than the diameter of the table tennis ball, penetrating therethrough.

In a feature of this aspect, each of the plurality of table modules is separated from at least one other table module by a substantial distance.

In a further feature of this aspect, the opening is covered by a basket supported and extending beneath the top member.

In a further feature of this aspect, the opening is circular.

In a further feature of this aspect, the distance is at least as great as a substantial fraction of the length or width of the top member.

In a further feature of this aspect, the distance is at least 2.25 feet.

In a further feature of this aspect, every one of the plurality of table modules is separated from all other table modules by a substantial distance.

In a further feature of this aspect, the support system provides an adjustable height for at least a portion of the top member.

In a further feature of this aspect, the support system includes an adjustable-height tripod.

In a further feature of this aspect, the tripod is mounted to the top member at a location substantially adjacent the center of a bottom surface of the top member.

In a further feature of this aspect, the top member is mounted to the tripod via an adjustable mounting assembly having a first part connected to a top of the tripod and a second part connected to the top member, wherein the second part is rotatable, relative to the first part, about an axis of rotation.

In a further feature of this aspect, the support system has a plurality of legs of adjustable length.

In a further feature of this aspect, the top member is mounted to the legs at substantially separated locations on the bottom surface of the top member.

In a further feature of this aspect, the plurality of legs includes exactly three legs.

In a further feature of this aspect, the top member is adapted to be tilted by adjusting the length of a first of the plurality of legs to be different than the length of a second of the plurality of legs.

In a further feature of this aspect, the top member of at least one table module has a playing surface that is tilted at a substantially non-vertical angle relative to horizontal.

The present invention according to a third aspect is a modular table tennis game set, including a plurality of paddles; a table tennis ball; and a plurality of table modules, each having a top member having a playing surface that is tilted at a substantially non-vertical angle relative to horizontal, and a support system on which the top member is mounted.

In a feature of this aspect, each of the plurality of table modules is separated from at least one other table module by a substantial distance.

In a further feature of this aspect, the top member of a first of the plurality of table modules is tilted at a first angle relative to horizontal, and the top member of a second of the plurality of table modules is tilted at a second angle relative to horizontal.

In a further feature of this aspect, the top member of a first of the plurality of table modules is tilted toward a second of the plurality of table modules.

In a further feature of this aspect, the top member of a first of the plurality of table modules is tilted away from a second of the plurality of table modules.

In a further feature of this aspect, the distance is at least as great as a substantial fraction of the length or width of the top member.

In a further feature of this aspect, the distance is at least 2.25 feet.

In a further feature of this aspect, every one of the plurality of table modules is separated from all other table modules by a substantial distance.

In a further feature of this aspect, the support system provides an adjustable height for at least a portion of the top member.

In a further feature of this aspect, the support system includes an adjustable-height tripod.

In a further feature of this aspect, the tripod is mounted to the top member at a location substantially adjacent the center of a bottom surface of the top member.

In a further feature of this aspect, the top member is mounted to the tripod via an adjustable mounting assembly having a first part connected to a top of the tripod and a second part connected to the top member, wherein the second part is rotatable, relative to the first part, about an axis of rotation.

In a further feature of this aspect, the support system includes a plurality of legs of adjustable length.

In a further feature of this aspect, the top member is mounted to the legs at substantially separated locations on the bottom surface of the top member.

In a further feature of this aspect, the plurality of legs includes exactly three legs.

In a further feature of this aspect, the length of a first of the plurality of legs is different than the length of a second of the plurality of legs, thereby causing the top member to be tilted.

In a further feature of this aspect, the playing surface of each top member has an opening, penetrating therethrough, with a diameter that is substantially greater than the diameter of the table tennis ball.

The present invention according to a fourth aspect is a modular table tennis game set, including a plurality of paddles; a table tennis ball; and a plurality of table modules, each having a top member having a playing surface, at least one support leg adapted to provide freestanding support for the top member, and an adjustable mounting assembly, having a first part and a second part, connecting the top member to the at least one support leg, the second part being coupled to the first part such that the second part is rotatable, relative to the first part, about an axis of rotation.

In a feature of this aspect, each of the plurality of table modules is separated from at least one other table module by a substantial distance.

In a further feature of this aspect, the distance is at least as great as a substantial fraction of the length or width of the top member.

In a further feature of this aspect, the distance is at least 2.25 feet.

In a further feature of this aspect, every one of the plurality of table modules is separated from all other table modules by a substantial distance.

In a further feature of this aspect, the support system provides an adjustable height for at least a portion of the top member.

In a further feature of this aspect, the support system includes an adjustable-height tripod.

In a further feature of this aspect, the tripod is mounted to the top member at a location substantially adjacent the center of a bottom surface of the top member.

In a further feature of this aspect, the top member is mounted to the tripod via an adjustable mounting assembly having a first part connected to a top of the tripod and a second part connected to the top member, wherein the second part is rotatable, relative to the first part, about an axis of rotation.

In a further feature of this aspect, the support system includes a plurality of legs of adjustable length.

In a further feature of this aspect, the top member is mounted to the legs at substantially separated locations on the bottom surface of the top member.

In a further feature of this aspect, the plurality of legs includes exactly three legs.

In a further feature of this aspect, the top member is adapted to be tilted by adjusting the length of a first of the plurality of legs to be different than the length of a second of the plurality of legs.

In a further feature of this aspect, the top member of at least one table module has a playing surface that is tilted at a substantially non-vertical angle relative to horizontal.

In a further feature of this aspect, the playing surface of each top member has an opening, penetrating therethrough, with a diameter that is substantially greater than the diameter of the table tennis ball.

The present invention according to a fifth aspect is a modular table tennis game set, including a plurality of paddles; a table tennis ball; and at least three table modules, each having a top member having a playing surface, and a support system, on which the top member is mounted.

In a feature of this aspect, each of the table modules is separated from at least one other table module by a substantial distance.

In a further feature of this aspect, the distance is at least as great as a substantial fraction of the length or width of the top member.

In a further feature of this aspect, the distance is at least 2.25 feet.

In a further feature of this aspect, all three of the table modules are separated from each other by a substantial distance.

In a further feature of this aspect, the table modules are arranged in a circle.

In a further feature of this aspect, at least one table modular is oriented vertically.

In a further feature of this aspect, the support system provides an adjustable height for at least a portion of the top member.

In a further feature of this aspect, the support system includes an adjustable-height tripod.

In a further feature of this aspect, the tripod is mounted to the top member at a location substantially adjacent the center of a bottom surface of the top member.

In a further feature of this aspect, the top member is mounted to the tripod via an adjustable mounting assembly having a first part connected to a top of the tripod and a second part connected to the top member, wherein the second part is rotatable, relative to the first part, about an axis of rotation.

In a further feature of this aspect, the support system has a plurality of legs of adjustable length.

In a further feature of this aspect, the top member is mounted to the legs at substantially separated locations on the bottom surface of the top member.

In a further feature of this aspect, the plurality of legs has exactly three legs.

In a further feature of this aspect, the top member is adapted to be tilted by adjusting the length of a first of the plurality of legs to be different than the length of a second of the plurality of legs.

In a further feature of this aspect, the top member of at least one table module has a playing surface that is tilted at a substantially non-vertical angle relative to horizontal.

In a further feature of this aspect, the playing surface of each top member has an opening, penetrating therethrough, with a diameter that is substantially greater than the diameter of the table tennis ball.

The present invention according to a sixth aspect is a modular table tennis game set, including a plurality of paddles; a table tennis ball; and a plurality of table modules, each having a top member having a playing surface that is substantially wedge-shaped, and a support system, on which the top member is mounted.

In a feature of this aspect, each of the plurality of table modules is separated from at least one other table module by a substantial distance.

In a further feature of this aspect, the distance is at least as great as a substantial fraction of the length or width of the top member.

In a further feature of this aspect, the distance is at least 2.25 feet.

In a further feature of this aspect, every one of the plurality of table modules is separated from all other table modules by a substantial distance.

In a further feature of this aspect, the support system provides an adjustable height for at least a portion of the top member.

In a further feature of this aspect, the support system has an adjustable-height tripod.

In a further feature of this aspect, the tripod is mounted to the top member at a location substantially adjacent the center of a bottom surface of the top member.

In a further feature of this aspect, the top member is mounted to the tripod via an adjustable mounting assembly having a first part connected to a top of the tripod and a second part connected to the top member, wherein the second part is rotatable, relative to the first part, about an axis of rotation.

In a further feature of this aspect, the support system has a plurality of legs of adjustable length.

In a further feature of this aspect, the top member is mounted to the legs at substantially separated locations on the bottom surface of the top member.

In a further feature of this aspect, the plurality of legs has exactly three legs.

In a further feature of this aspect, the top member is adapted to be tilted by adjusting the length of a first of the plurality of legs to be different than the length of a second of the plurality of legs.

In a further feature of this aspect, the top member of at least one table module has a playing surface that is tilted at a substantially non-vertical angle relative to horizontal.

In a further feature of this aspect, the playing surface of each top member has an opening, penetrating therethrough, with a diameter that is substantially greater than the diameter of the table tennis ball.

The present invention according to a seventh aspect is a modular table tennis game set, including a plurality of paddles; a table tennis ball; and a plurality of table modules, each having a top member having a playing surface, and exactly three legs supporting the top member.

In a feature of this aspect, each of the plurality of table modules is separated from at least one other table module by a substantial distance.

In a further feature of this aspect, the distance is at least as great as a substantial fraction of the length or width of the top member.

In a further feature of this aspect, the distance is at least 2.25 feet.

In a further feature of this aspect, every one of the plurality of table modules is separated from all other table modules by a substantial distance.

In a further feature of this aspect, the support system provides an adjustable height for at least a portion of the top member.

In a further feature of this aspect, the support system has an adjustable-height tripod.

In a further feature of this aspect, the tripod is mounted to the top member at a location substantially adjacent the center of a bottom surface of the top member.

In a further feature of this aspect, the top member is mounted to the tripod via an adjustable mounting assembly having a first part connected to a top of the tripod and a second part connected to the top member, wherein the second part is rotatable, relative to the first part, about an axis of rotation.

In a further feature of this aspect, the support system has legs of adjustable length.

In a further feature of this aspect, the top member is mounted to the legs at substantially separated locations on the bottom surface of the top member.

In a further feature of this aspect, the top member is adapted to be tilted by adjusting the length of one leg to be different than the length of the other two legs.

In a further feature of this aspect, the top member of at least one table module has a playing surface that is tilted at a substantially non-vertical angle relative to horizontal.

In a further feature of this aspect, the playing surface of each top member has an opening, penetrating therethrough, with a diameter that is substantially greater than the diameter of the table tennis ball.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
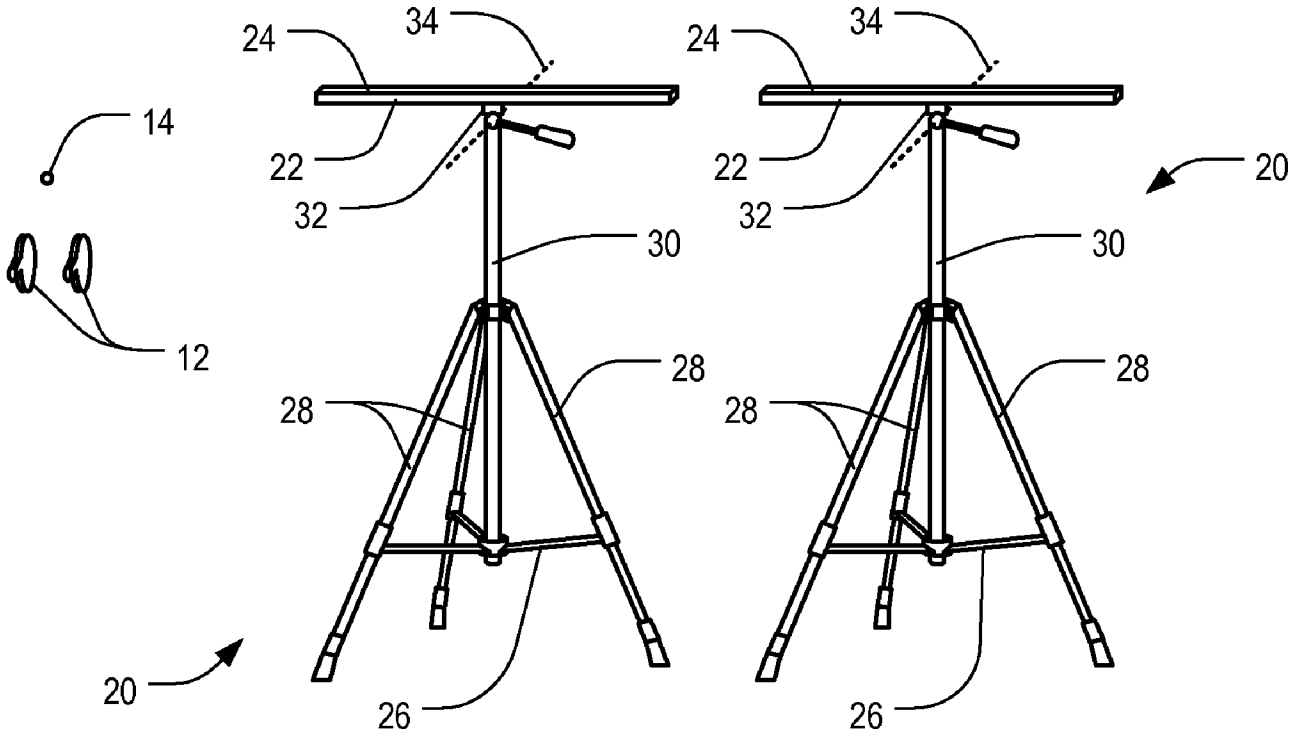
FIG. 1 is a side perspective view of the elements of a modular table tennis game set in accordance with a first preferred embodiment of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, the preferred embodiments of the present invention are next described. The following description of the preferred embodiment(s) is merely exemplary in nature and is in no way intended to limit the invention, its application, or uses.

FIG. 1 is a side perspective view of the elements of a modular table tennis game set 10 in accordance with the preferred embodiments of the present invention. The game set 10 includes two table modules 20, two paddles 12, and a ball 14. The paddles 12 and ball 14 may each be of the type conventionally used to play the game of table tennis, often known as ping-pong. In at least one proposed commercial embodiment, the elements shown in FIG. 1 are packaged and sold together; however, it will be apparent that the table modules 20 may be sold with or without the other elements, and likewise may be sold individually or in larger groups, all without departing from the scope of the present invention.

Each table module 20 includes a top member 22, preferably having a playing surface 24 of a composition conventionally used for table tennis playing surfaces, supported by a tripod 26. The tripod 26 may be of generally conventional tripod construction including three legs 28 whose length is adjustable, a center post 30 supported by the legs 28, and an adjustable mounting assembly 32 supported by the center post 30 and adapted to support the top member 22. More particularly, a first part of the adjustable mounting assembly 32 is rotatable relative, to a second part, around at least one axis of rotation 34 such that the top member 22 may be tilted as discussed hereinbelow.

Figure 2:
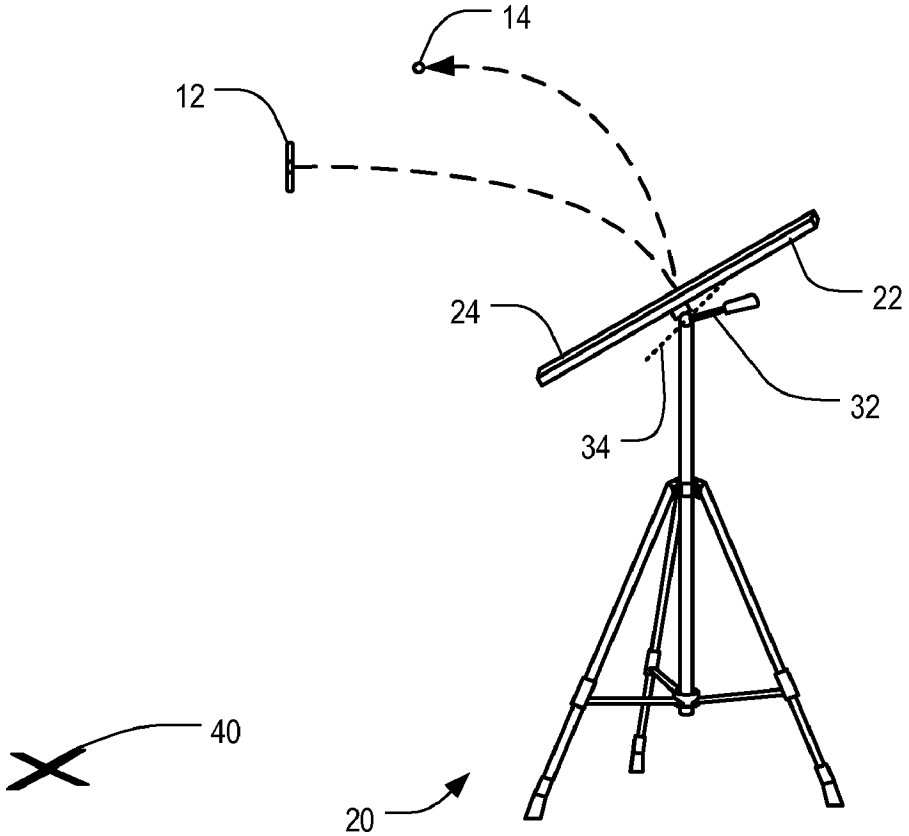
FIG. 2 is a side perspective view of one of the table modules of FIG. 1 illustrating a first mode of play.

FIG. 2 is a side perspective view of one of the table modules 20 of FIG. 1 illustrating a first mode of play. In particular, FIG. 2 illustrates a one-person game wherein a player stands at a location 40 that is a chosen distance from the table module 20, holding a paddle 12, and strikes the ball 14 with the paddle 12 such that it flies through the air and hits the playing surface 24, bounces in the air and flies back toward the player. The mounting assembly 32 may be adjusted by rotating the portion to which the top member 22 is mounted around the axis 34 so as to tilt the top member 22 an appropriate amount to cause the ball 14 to bounce back toward the player at a desired angle. The mounting assembly 32 may be capable of infinite adjustment or it may be arranged to provide one or more preset positions, representing preset angles, from which the player can select the desired tilt.

The player may adjust his or her location 40 as necessary to strike the ball successfully, such as by moving forward, backward or side-to-side. The player may challenge himself or herself to repeat the sequence described above as many times in a row as possible or may merely repeat the sequence a desired number of times at different angles so as to improve his table tennis skills generally.

Figure 3:
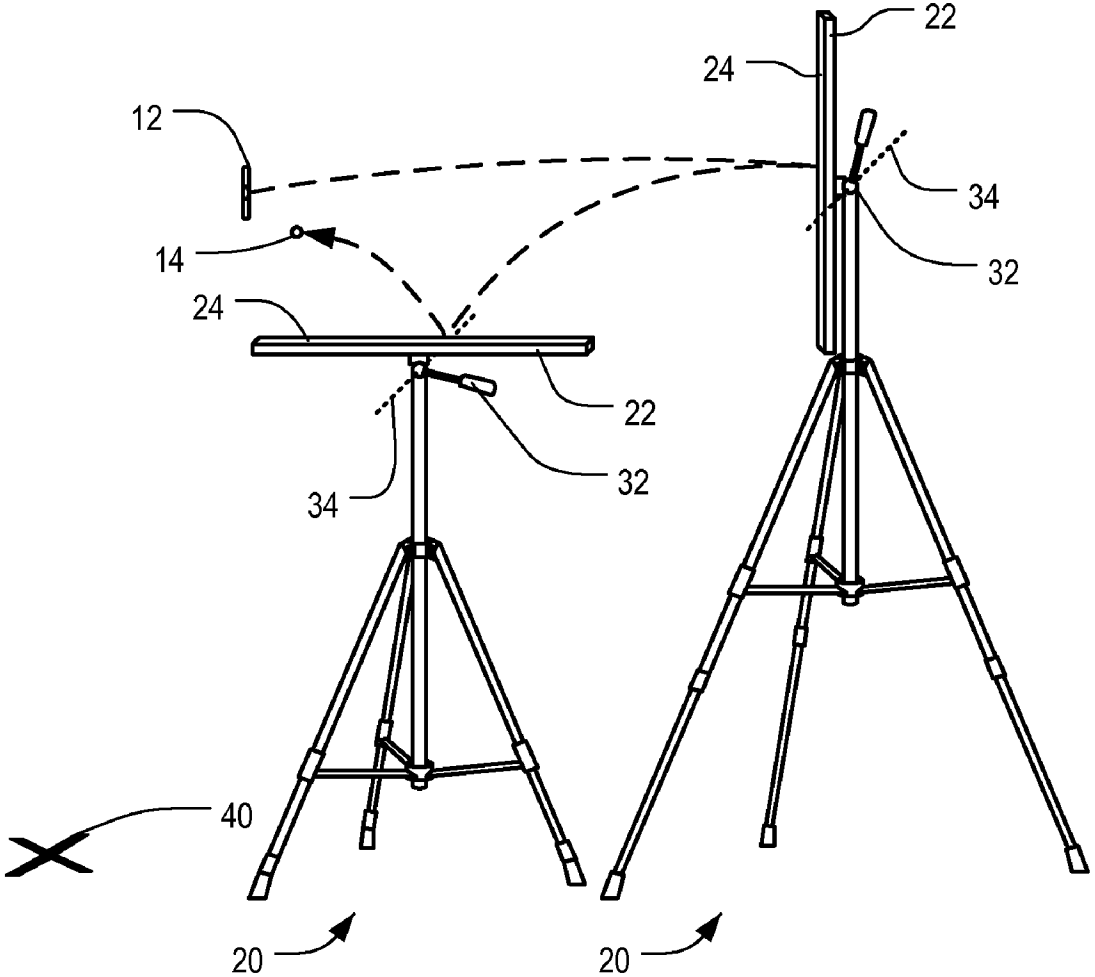
FIG. 3 is a side perspective view of the table modules of FIG. 1 illustrating a second mode of play.

FIG. 3 is a side perspective view of the table modules 20 of FIG. 1 illustrating a second mode of play. In particular, FIG. 3 illustrates another one-person game wherein a player stands at a location 40 a chosen distance from one side of a first table module 20, oriented generally horizontally, with a second table module 20, oriented generally vertically, positioned a chosen distance from the opposite side of the first table module 20. These orientations may be achieved once again by rotating each respective top member 22 around its axis 34 to the desired orientation. If preset positions are to be provided, representing preset angles, it is preferred that two of the preset positions that are provided are those necessary to place the top member 22 at a horizontal orientation and to place the top member 22 at a vertical orientation.

In the game illustrated in FIG. 3, the player strikes the ball 14 with the paddle 12 such that it flies through the air and hits the playing surface 24 of the second table module 20, bounces back toward the playing surface 24 of the first table module 20, and from there flies back toward the player. Once again, the player may adjust his or her location 40 as necessary to strike the ball successfully, such as by moving forward, backward or side-to-side. The player may challenge himself or herself to repeat the sequence described above as many times in a row as possible or may merely repeat the sequence a desired number of times at different angles so as to improve his table tennis skills generally.

Alternatively, if only one table module 20 is available, or if the player wishes to enjoy a different playing experience, other vertical surfaces, such as an interior wall in a house or the like, may be substituted for the second table module 20.

Figure 4:
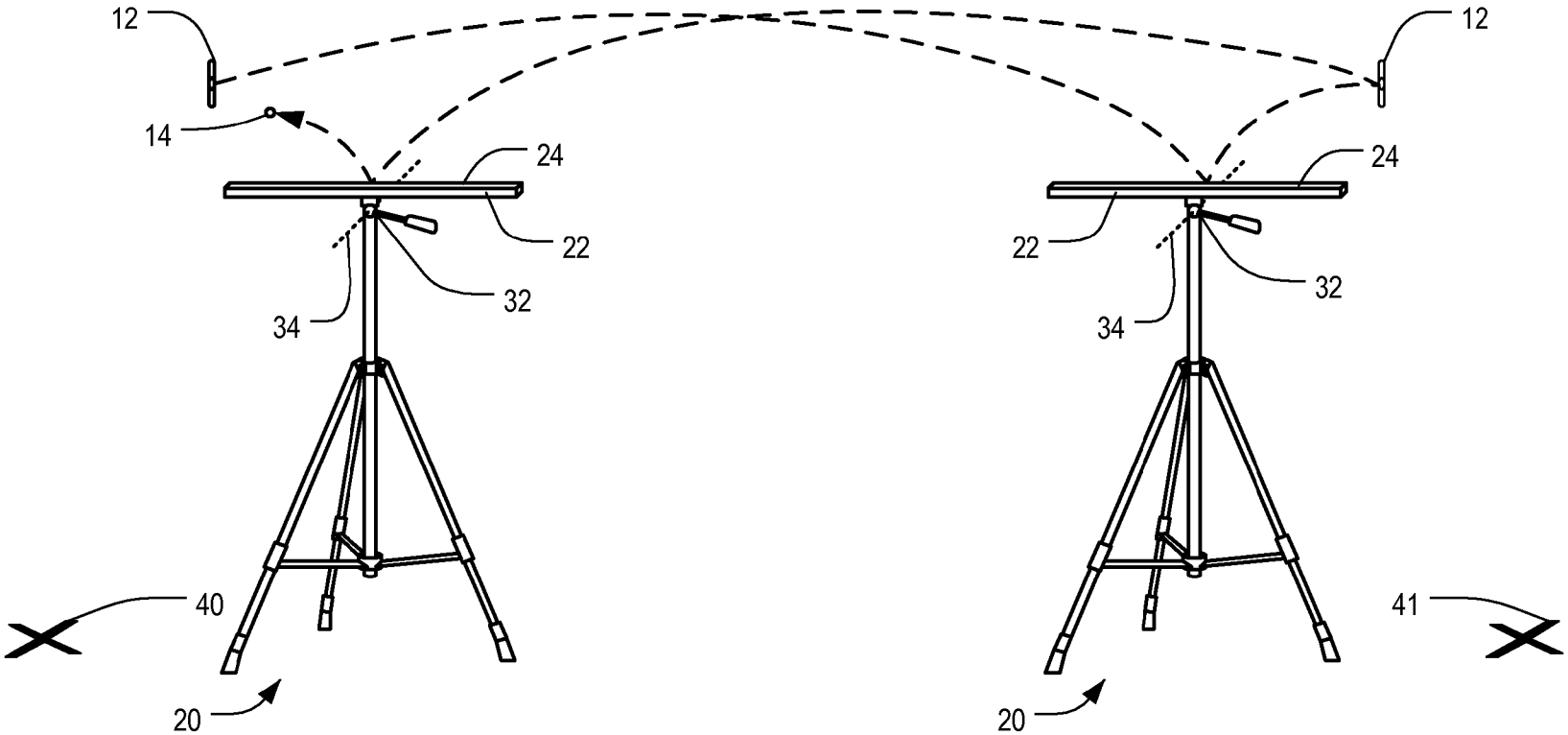
FIG. 4 is a side perspective view of the elements of the modular table tennis game set of FIG. 1 illustrating a third mode of play.

FIG. 4 is a side perspective view of the elements of the modular table tennis game set 10 of FIG. 1 illustrating a third mode of play. In particular, FIG. 4 illustrates a two-person game wherein a first player, holding a paddle 12, stands at a location 40 a chosen distance from a first table module 20, and a second player, also holding a paddle 12, stands at a location 41 a chosen distance from a second table module 20. Each table is oriented generally horizontally, and the two table modules 20 are spaced a desired distance apart. Generally speaking, the greater the distance between the table modules 20, the more difficult it may be for each player to hit their opponent's table surface 24 with his or her shots.

To play, the first player strikes the ball 14 with the paddle 12 such that it flies through the air and hits the playing surface 24 of the second table module 20 and bounces up toward the second player. The second player then strikes the ball 14 with his or her paddle 12 such that it flies through the air and hits the playing surface 24 of the first table module 20 and bounces up toward the first player. In similar fashion to conventional table tennis, the players repeat this sequence until one player fails to return the ball 14 to his opponent's playing surface 24, either by failing to strike the ball 14 or by striking the ball 14 in such a way that it fails to make contact with his opponent's playing surface 24.

Figure 5:
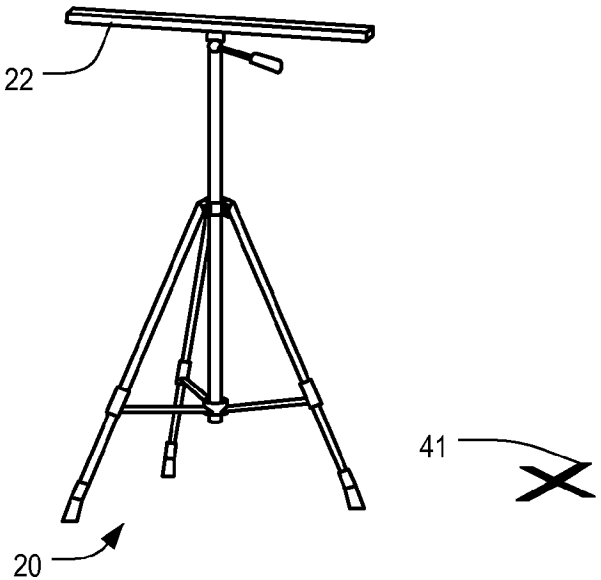
FIG. 5 is a side perspective view of the table modules of FIG. 1 illustrating a fourth mode of play.
Figure 5:
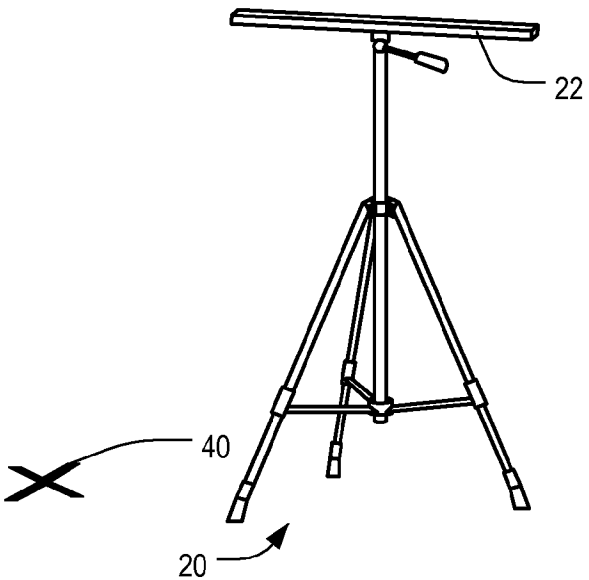

FIG. 5 is a side perspective view of the table modules 20 of FIG. 1 illustrating a fourth mode of play. Though play is generally similar to that described with regard to FIG. 4, the top members 22 of the table modules 20 have each been tilted slightly so as to accommodate different skill levels or to make game play more interesting. More particularly, the top member 22 on the right has been tilted away from a first player, standing at a first location 40, while the top member on the left has been tilted toward a second player, standing at a second location 41. By tilting the top member 22 on the right away from the first player, it becomes more difficult for the first player to hit hard shots at the second player because the apparent target area is smaller in the vertical direction than normal, thereby making it more difficult to hit the surface with a sharply struck ball 14. Conversely, by tilting the top member 22 on the left toward the second player, it becomes easier for the second player to hit hard shots, or perhaps any sorts of shots, at the first player because the apparent target area is larger in the vertical direction than normal, thereby making it easier to hit the surface with the ball 14.

Figure 6:
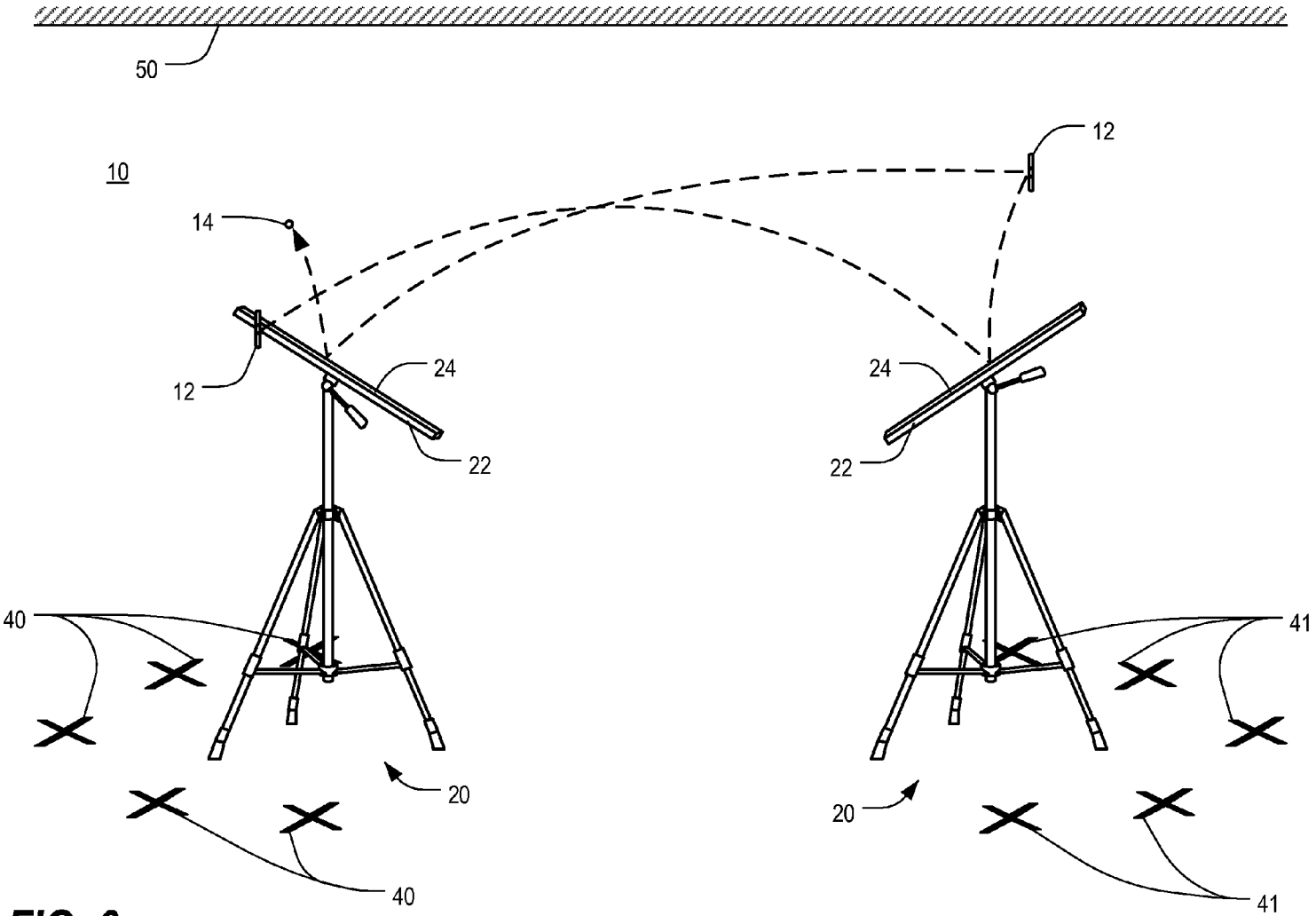
FIG. 6 is a side perspective view of the elements of the modular table tennis game set of FIG. 1 illustrating a fifth mode of play.

FIG. 6 is a side perspective view of the elements of the modular table tennis game set 10 of FIG. 1 illustrating a fifth mode of play. In particular, FIG. 6 illustrates a two-person game wherein a first player, holding a paddle 12, stands at any of a plurality of locations 40 around a first table module 20, and a second player, also holding a paddle 12, stands at any of a plurality of locations 41 around a second table module 20. The table modules 20 are spaced apart as in FIG. 4, but each top member 22 is significantly angled in a manner somewhat similar to that of FIG. 2. Unlike the arrangement in FIG. 2, however, each top member 22 is angled so that a ball 14 struck by the opposing player bounces almost straight up in the air, making it somewhat difficult to reach and strike the ball 14 to return it to the opponent's table surface 24. Otherwise, game play may be similar to that described with regard to FIGS. 4 and 5, except that it may be desired to establish a rule against causing the ball 14 to bounce so high as to hit the ceiling 50 of a room in which the game is being played. Notably, it may also be necessary for each player to change locations 40,41 frequently in response to the greater difficulty that may be inherent in trying to reach and successfully strike a ball 14 bouncing off an angled playing surface 24.

Figure 7A:
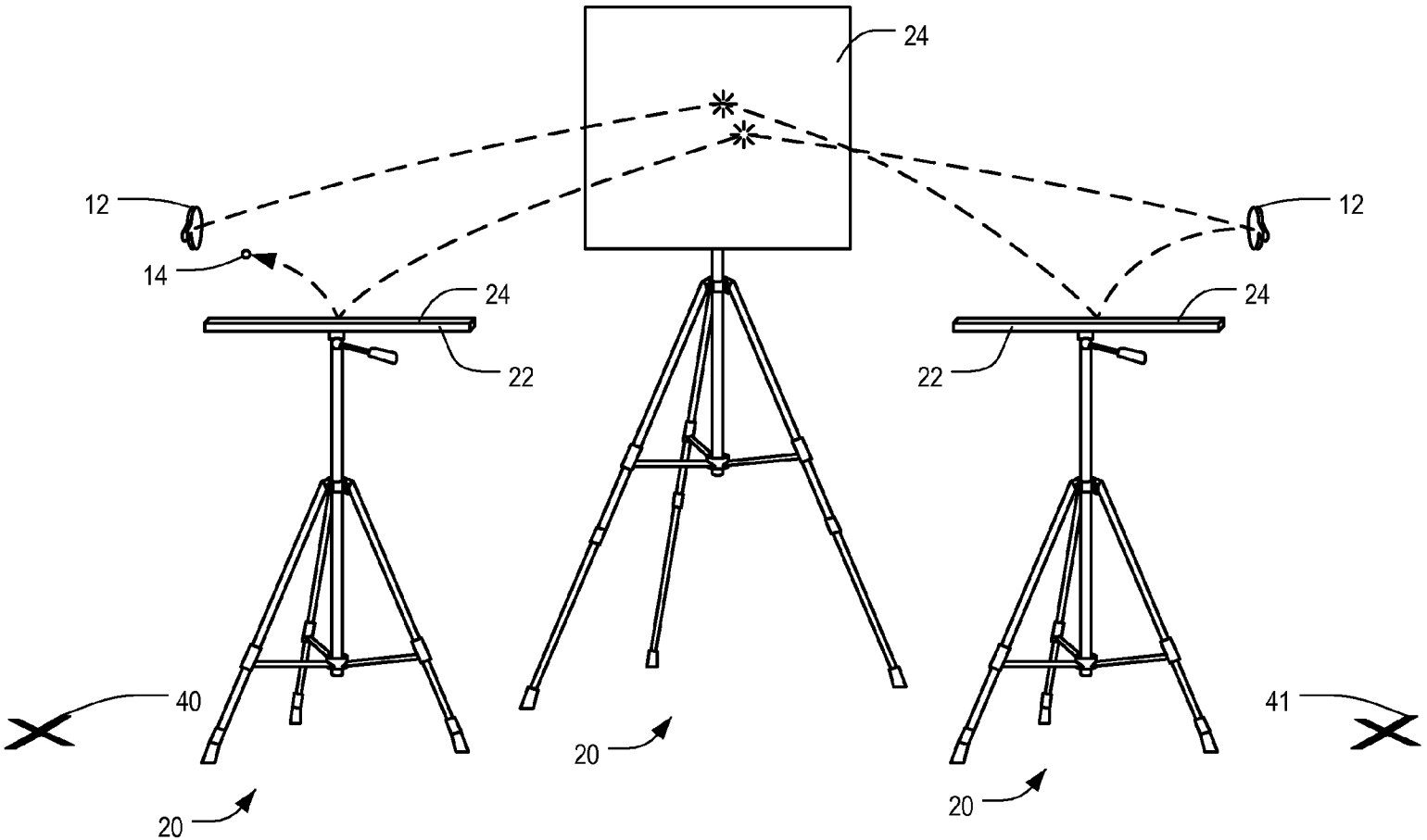
FIGS. 7A and 7B are a side perspective view and a top perspective view, respectively, of the elements of the modular table tennis game set of FIG. 1, together with an additional table module, illustrating a sixth mode of play.
Figure 7B:
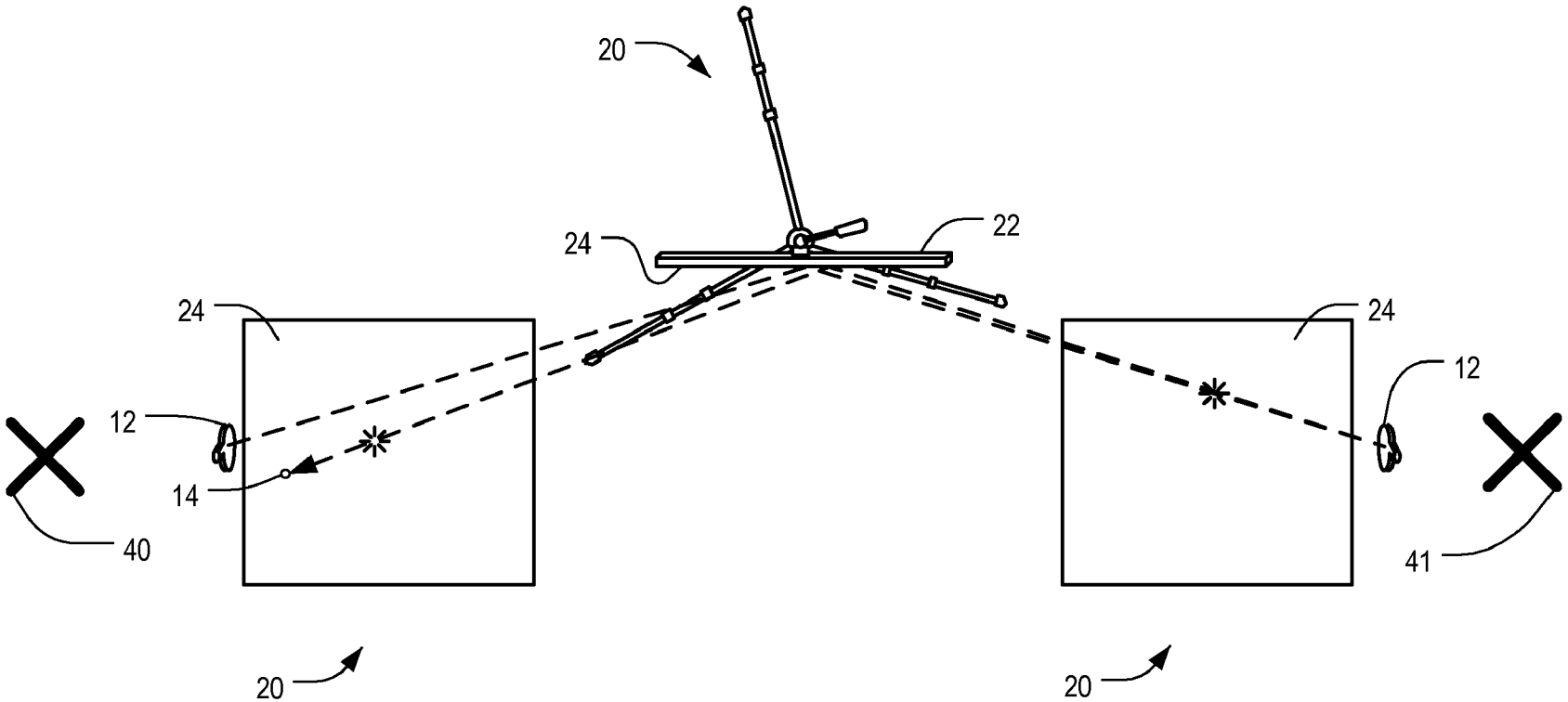

FIGS. 7A and 7B are a side perspective view and a top perspective view, respectively, of the elements of the modular table tennis game set 10 of FIG. 1, together with an additional table module 20, illustrating a sixth mode of play. Two of the table modules 20 are spaced apart with their top members 22 generally horizontal as in FIG. 4, but the third table module 20 is placed part way between the other modules 20 and off to the side (perhaps best shown in FIG. 7B). Such an arrangement may be used to play game variations incorporating elements of the game of racquetball, wherein the table surface 24 of the third table serves as a wall and is in play during the game.

To play, the first player strikes the ball 14 with the paddle 12 such that it flies through the air and hits the playing surface 24 of the third table module 20, bounces and hits the playing surface 24 of the second table module 20, and then bounces up toward the second player. The second player then strikes the ball 14 with his or her paddle such that it flies through the air and hits the playing surface 24 of the third table module 20, bounces and hits the playing surface 24 of the first table module 20, and finally bounces up toward the first player. In similar fashion to conventional table tennis, the players repeat this sequence until one player fails to return the ball 14 to his opponent's playing surface 24 via the third playing surface 24, either by failing to strike the ball 14 or by striking the ball 14 in such a way that it fails to make contact with his opponent's playing surface 24 after making contact with the third playing surface 24. In variations, players may or may not be required to hit every shot such that the ball 14 strikes the third playing surface 24 before striking his opponent's playing surface 24.

Alternatively, if an additional table module 20 is not available, or if the player wishes to enjoy a different playing experience, other vertical surfaces, such as an interior wall in a house or the like, may be substituted for the third table module 20.

Figure 8A:
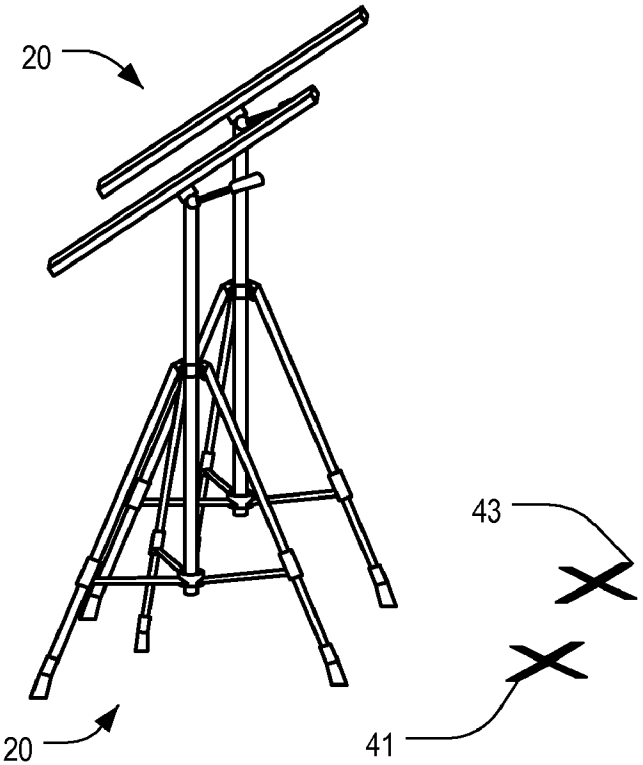
FIGS. 8A and 8B are a side perspective view and a top perspective view, respectively, of the elements of the modular table tennis game set of FIG. 1, together with two additional table modules, illustrating a seventh mode of play.
Figure 8A:
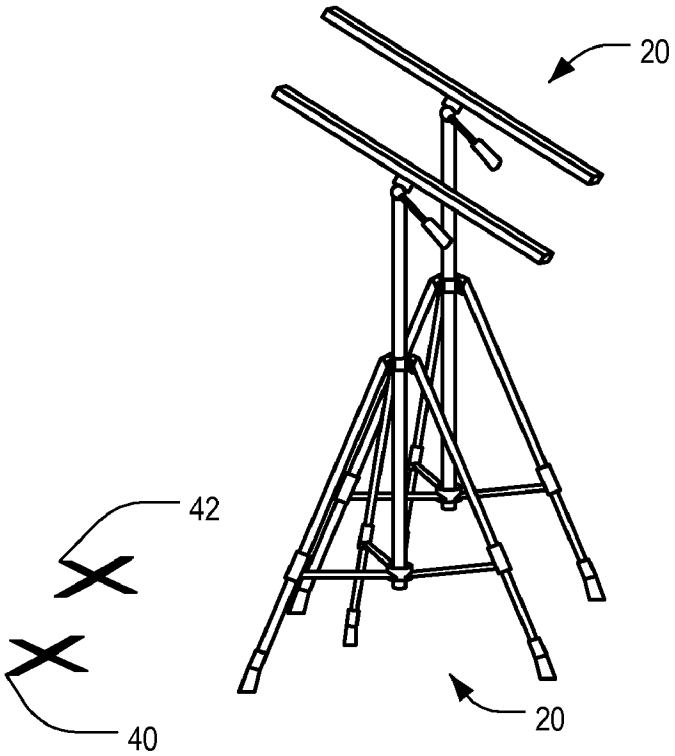
Figure 8B:
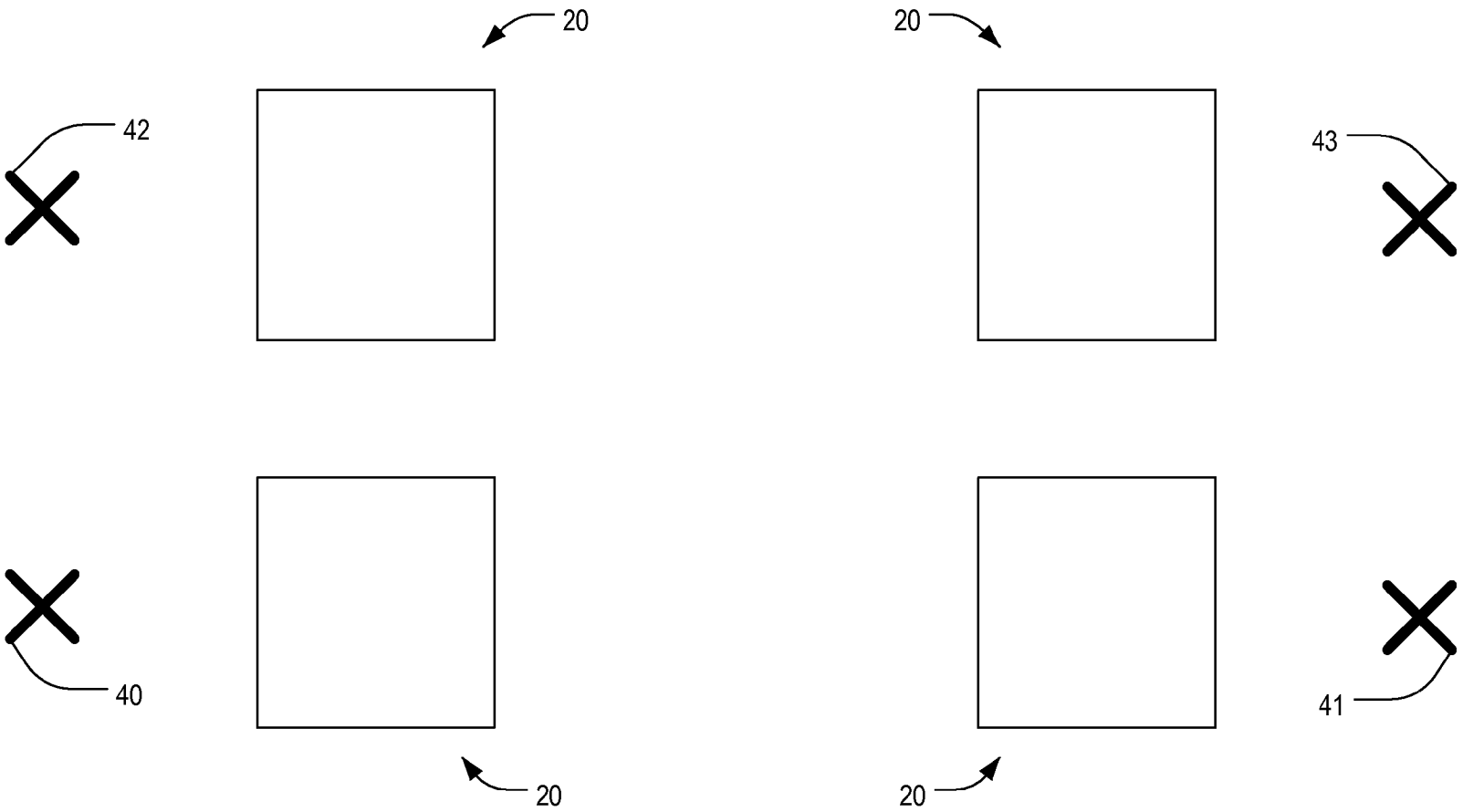

FIGS. 8A and 8B are a side perspective view and a top perspective view, respectively, of the elements of the modular table tennis game set 10 of FIG. 1, together with two additional table modules 20, illustrating a seventh mode of play. More particularly, two pairs of table modules 20 are arranged to face each other, with the table modules 20 in each pair aligned with each other. The table modules 20 in each pair may be placed right next to each other or spaced apart by some distance. Four players are involved, with each player standing at a location 40,41,42,43 behind or beside a respective table module 20, facing the opposite table modules 20 and the players standing therebehind. Game play is similar to that described with respect to FIG. 4, except that doubles table tennis rules may be incorporated if desired. In other words, the players in locations 40,42 beside the left pair of table modules 20 play as partners, and attempt, when striking the ball 14, to cause the ball 14 to hit either of the table modules 20 of the right pair, and vice versa. In variations, either player in a partnership may strike the ball 14 regardless of whether the ball 14 hits their respective table module 20, or may be required to strike the ball 14 only when it hits their own table module 20. In other variations, the players in one partnership may each attempt to hit either table module 20 of the other partnership, or may be required to alternate between table modules 20 of the other partnership.

Any of the variations described herein may be incorporated into the arrangement of FIGS. 8A and 8B. More particularly, the top members 22 of one or more (but not necessarily all) of the table modules 20 may be tilted to create a different game play experience, to accommodate different skill levels, or both. Additional table modules 20 may be oriented vertically to play a game incorporating elements of racquetball, or if additional table modules 20 are not available, or if the players wish to enjoy a still-different playing experience, other vertical surfaces, such as an interior wall in a house or the like, may be substituted for such additional table modules 20.

Figure 9:
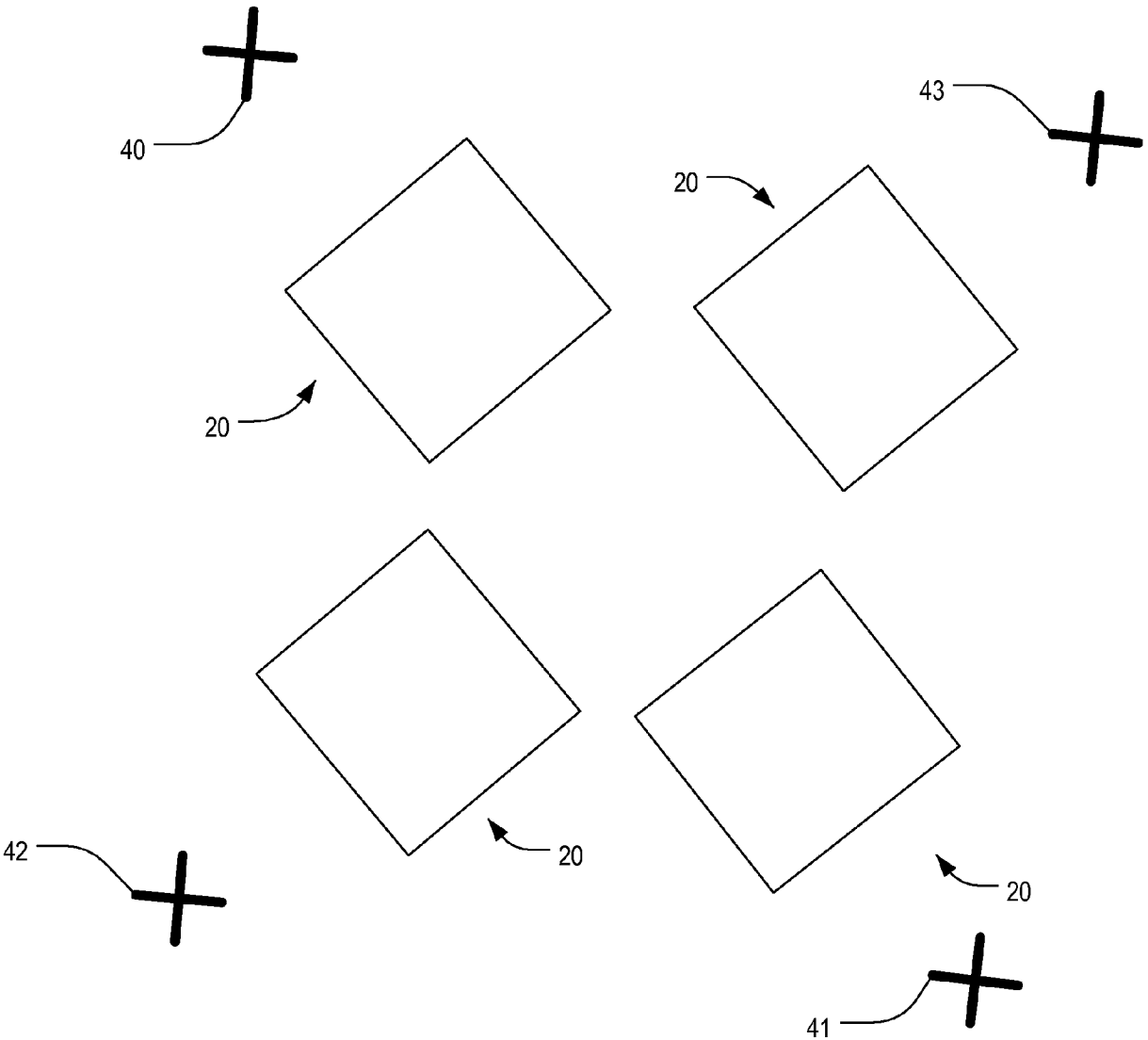
FIG. 9 is a top perspective view of the elements of the modular table tennis game set of FIG. 1, together with two additional table modules, illustrating an eighth mode of play.

FIG. 9 is a top perspective view of the elements of the modular table tennis game set 10 of FIG. 1, together with two additional table modules 20, illustrating an eighth mode of play. More particularly, the four table modules 20 of FIGS. 8A and 8B are rearranged so as to be at generally right angles to each other. In this arrangement, players can play as partners or as individuals. In at least one variation, a game incorporating elements of the traditional game of four-square may be played using this arrangement. Once again, any of the variations described herein may be incorporated into the arrangement of FIG. 9. More particularly, the top members 22 of one or more (but not necessarily all) of the table modules 20 may be tilted to create a different game play experience, to accommodate different skill levels, or both. Additional table modules 20 may be oriented vertically to play a game incorporating elements of racquetball, or if additional table modules 20 are not available, or if the players wish to enjoy a still-different playing experience, other vertical surfaces, such as an interior wall in a house or the like, may be substituted for such additional table modules 20.

Still other variations are likewise contemplated, including the arrangement of top members 22 at both a tilt angle as well as a side-to-side angle. Each mounting assembly 32 may be capable of adjustment around each of two or more axes to provide such functionality. Each tripod 26 is preferably also height-adjustable such that the level of the top member 22 may be raised and lowered to accommodate players of different heights or skill levels, to provide a different game playing experience, or even to allow players to sit down while playing, either on a conventional chair or stool or in a wheelchair. Of particular note, it may be possible for adults to play against children in a competitive environment by adjusting the top member height, tilt angle, or side to side angle, or to adjust other factors, in order to give each player a fair chance of winning a game.

In a further feature, each table module 20 may be portable, wherein straps or a carry bag could be used to facilitate transport from one location to another. Such a feature may make it possible for friends to gather to combine their respective table modules 20 to open up new game play possibilities, including at least some of those described herein. Portability may also facilitate outdoor play, wherein one or more of the games and game arrangements described and illustrated herein may be played outdoors, particularly if a heavier ball is available.

Figure 10A:
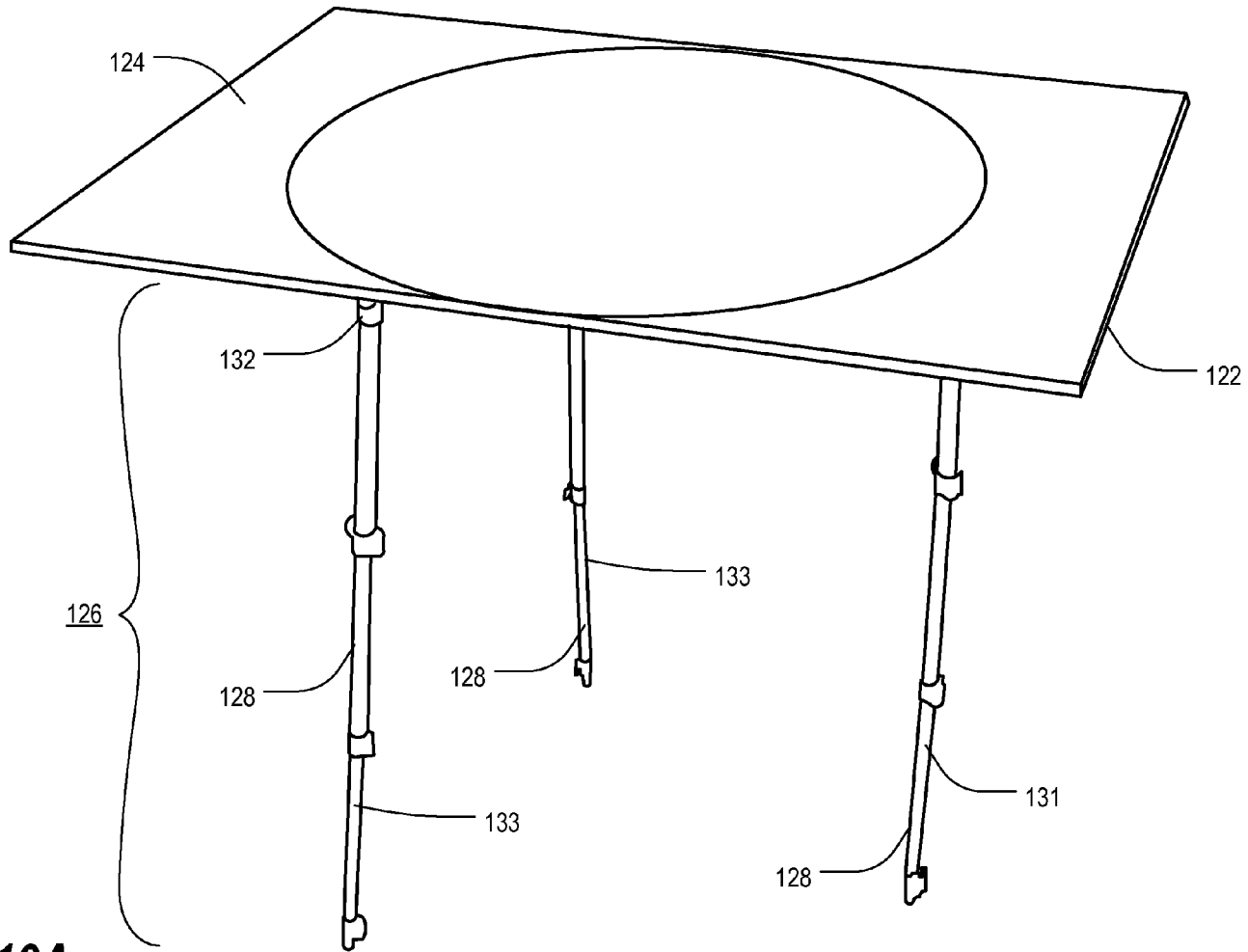
FIGS. 10A and 10B are perspective views of a table module of a modular table tennis game set in accordance with a second preferred embodiment of the present invention.
Figure 10B:
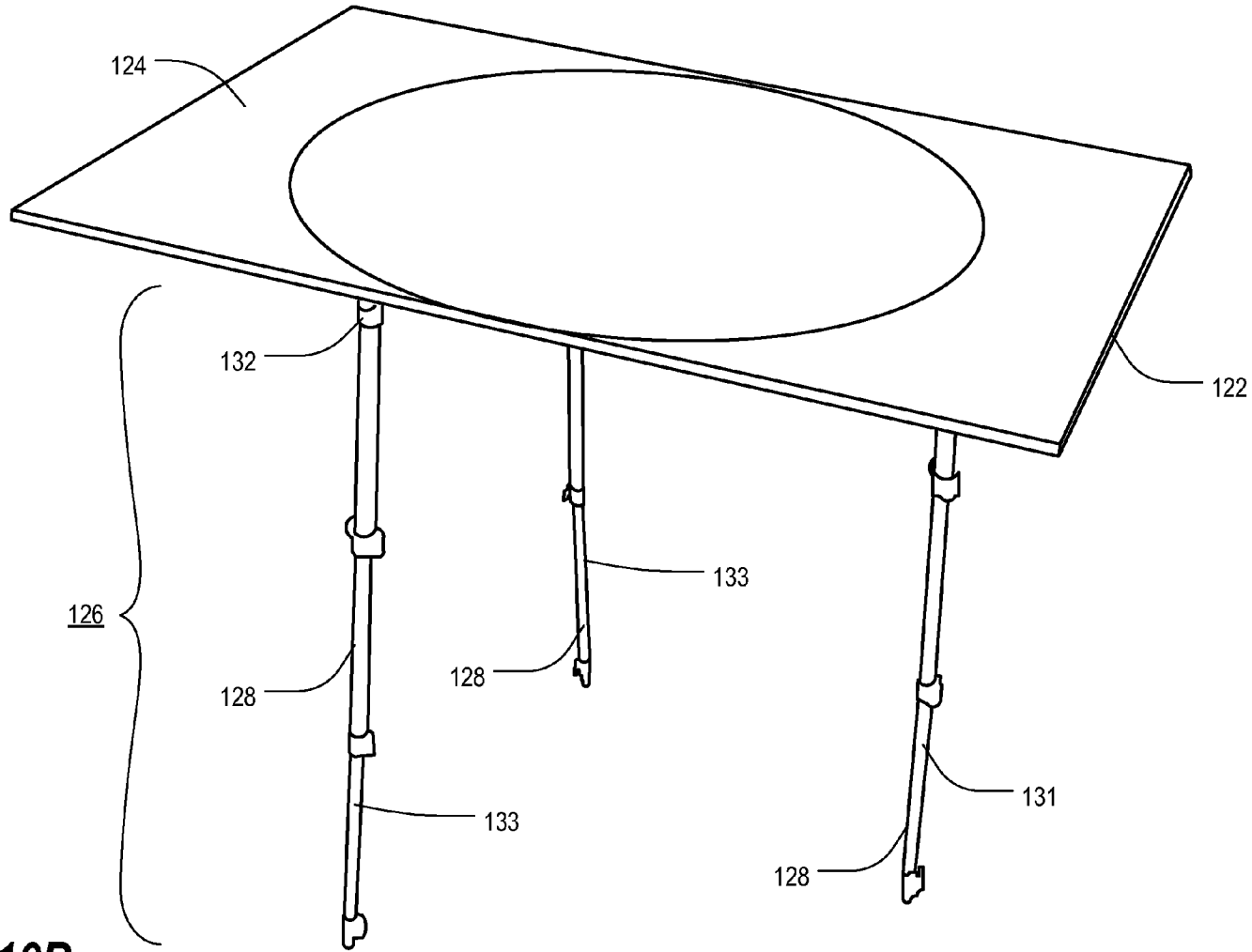

FIGS. 10A and 10B are perspective views of a table module 120 of a modular table tennis game set in accordance with a second preferred embodiment of the present invention. The table module 120 includes a top member 122, preferably having a playing surface 124 of a composition conventionally used for table tennis playing surfaces (though in the illustrated embodiment the top member 122 may be constructed from a piece of plywood and the playing surface 124 may merely be a top surface of the plywood), supported by a three-leg support system 126. More particularly, the three-leg support system 126 includes three adjustable legs 128, each of which may be of generally conventional adjustable- or extendable-leg construction, arranged around the periphery of the top member 122 to provide stable support therefor. By extending or retracting each individual leg 128, the top member 122 may be tilted as desired. More particularly, by adjusting the length of a first leg 131 relative to the other two legs 133, the portion of the top member 122 supported by the first leg 131 is raised or lowered accordingly relative to the other portions of the top member 122. In this way, the top member 122 may be adjusted, for example, from a generally horizontal orientation as shown in FIG. 10A to a tilted orientation as shown in FIG. 10B.

In some embodiments, each leg 128 may be attached to the top member 122 at a fixed angle, and the top member 122 is tilted without changing the angle between the top member 122 and any of the legs 128. In other embodiments, each leg 128 is connected to the top member 122 via an adjustable mounting assembly 132 that includes a first part fixed to the top of the leg and a second part fixed to the top member 122, with the second part being rotatable, relative to the first part, about at least one axis of rotation. The amount of rotation necessary may not be particularly great, but permits the top member 122 to be placed in a tilted orientation without unbalancing the module 120.

Figure 11:
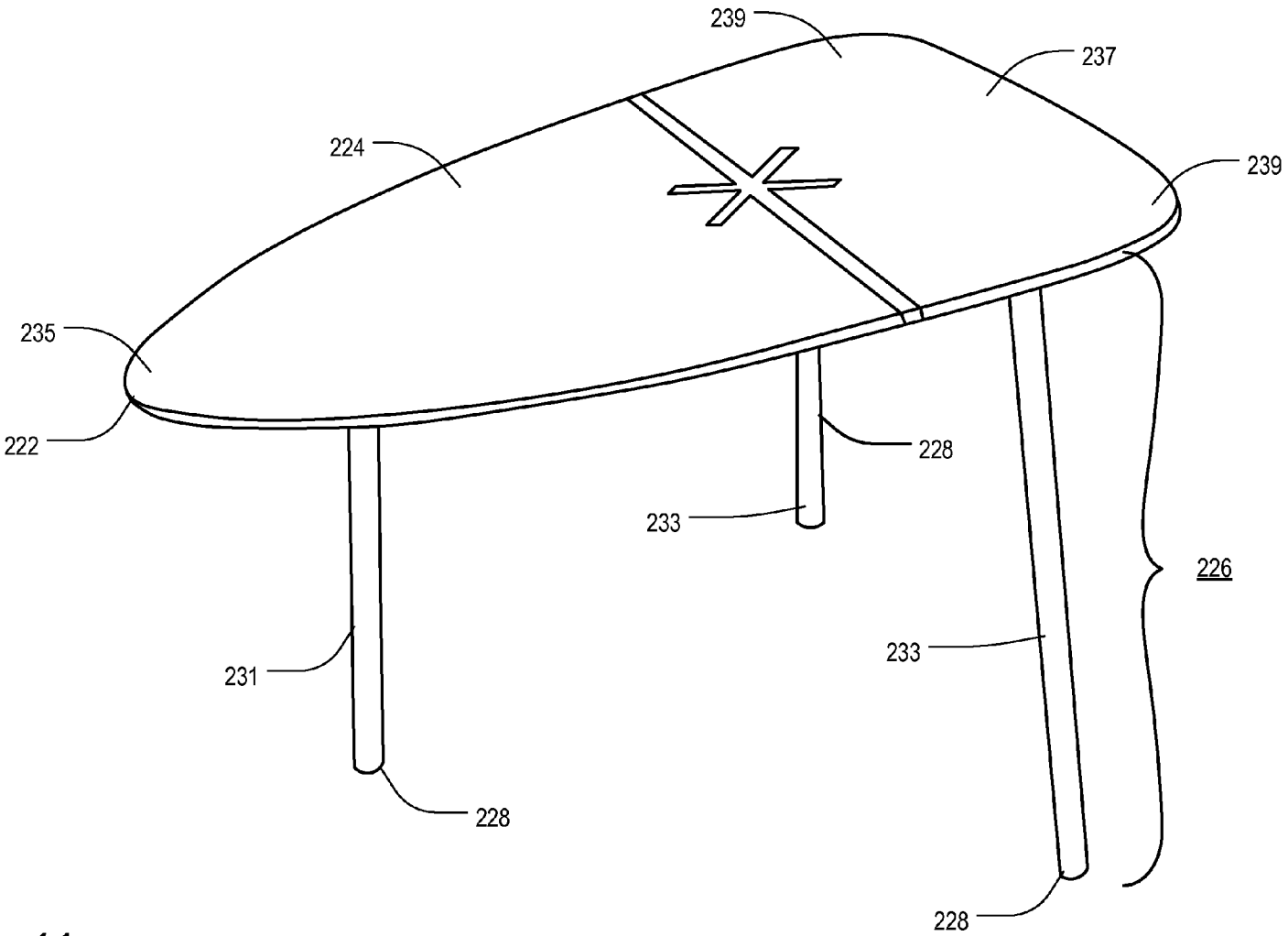
FIG. 11 is a perspective view of a table module of a modular table tennis game set in accordance with a third preferred embodiment of the present invention.

FIG. 11 is a perspective view of a table module 220 of a modular table tennis game set in accordance with a third preferred embodiment of the present invention. The table module 220 includes a top member 222, preferably having a playing surface 224 of a composition conventionally used for table tennis playing surfaces (though in the illustrated embodiment the top member 222 may be constructed from a piece of composition board, plywood or the like, and the playing surface 224 may merely be a top surface of the composition board), supported by a three-leg support system 226. The top member 222 is generally wedge-shaped to facilitate one or more methods of play, with a front end 235 of the top member 222 tapering to a curved nose and a rear end 237 having two distinct comers 239. The three-leg support system 226 includes three fixed-length legs 228, each of which may be of generally conventional construction, arranged around the periphery of the top member 222 to provide stable support therefor. In particular, legs of two different lengths are provided, with a shorter leg 231 disposed near the front end 235 of the table module 220 and two longer legs 233 disposed near the rear corners 239 of the module 220.

Though not illustrated, in at least one embodiment a wedge-shaped top member like the top member 222 of FIG. 11 may also be used with adjustable legs, such as those shown in FIG. 10, thereby providing additional variability. Still further, in at least one embodiment a wedge-shaped top member or other top members may be used with legs having limited adjustability, such as, by way of example, legs having three positions or length settings, thereby providing a long, medium and short leg length setting. In one such embodiment, a first leg disposed at the front of a wedge-shaped top member has a high setting that places the front end of the top member at the same height as the rear end of the top member when second and third legs disposed at the rear are placed in their lowest setting.

Figure 12:
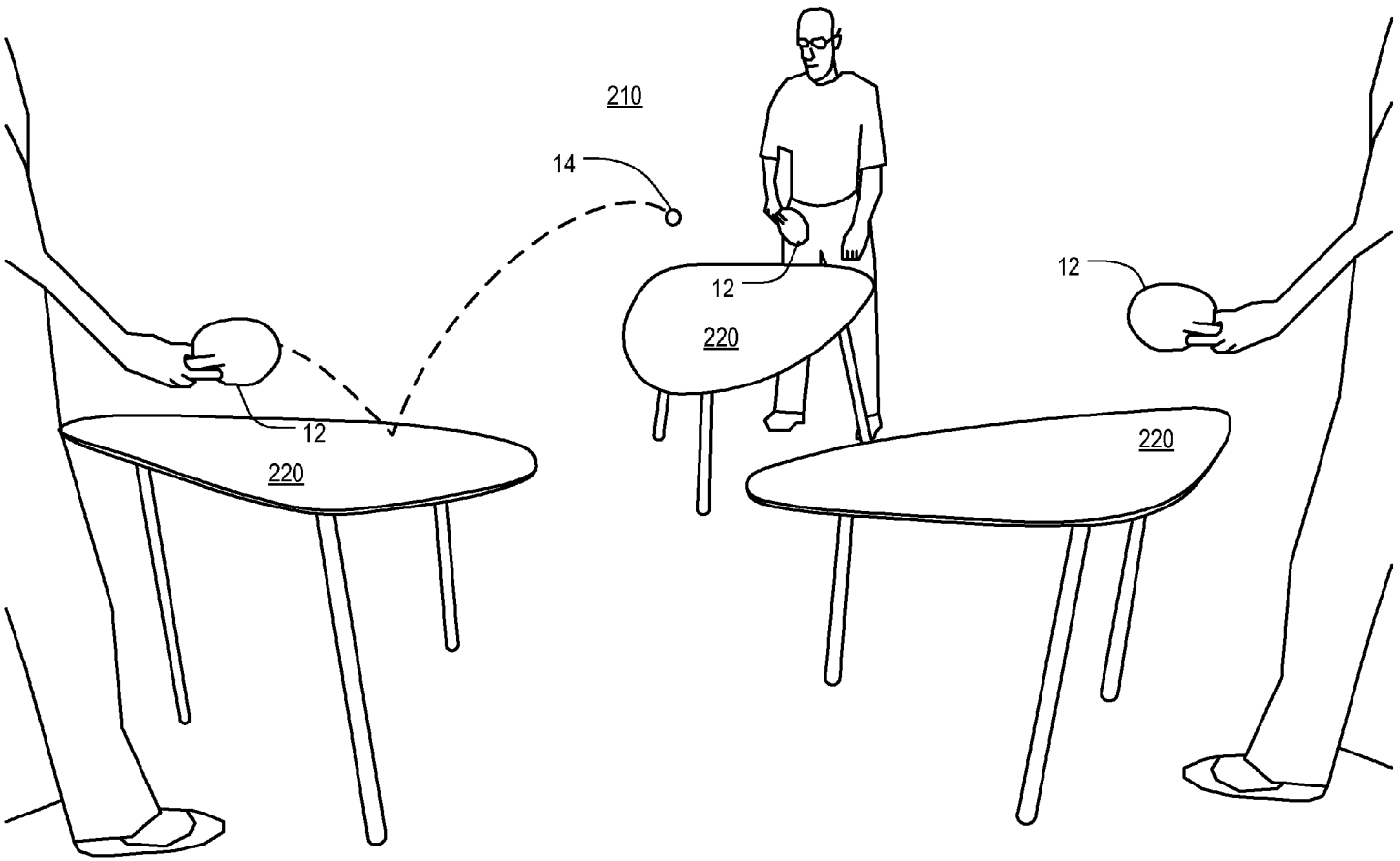
FIG. 12 is a perspective view of the elements, including three table modules of the type shown in FIG. 11, of a modular table tennis game set, illustrating a mode of play for a modular table tennis game.

FIG. 12 is a perspective view of the elements, including three table modules 220 of the type shown in FIG. 11, of a modular table tennis game set 210, illustrating a mode of play for a modular table tennis game. The game set 210 includes three table modules 220, three paddles 12, and a ball 14. Once again, the paddles 12 and ball 14 may each be of the type conventionally used to play ping-pong. In at least one proposed commercial embodiment, production versions of the elements shown in FIG. 12 may be packaged and sold together; however, it will be apparent that the table modules 220 may be sold with or without the other elements, and likewise may be sold individually or in larger groups, all without departing from the scope of the present invention. For example, in one embodiment, three table modules 220, three paddles 12 and one or more balls 14 would be sold together, while in another embodiment, two table modules 220, two paddles 12 and one or more balls 14 would be sold together with a third table module 220 available individually, and in still another embodiment, the paddles 12 would be sold separately, and each table module 220 would be sold separately.

Figure 13:
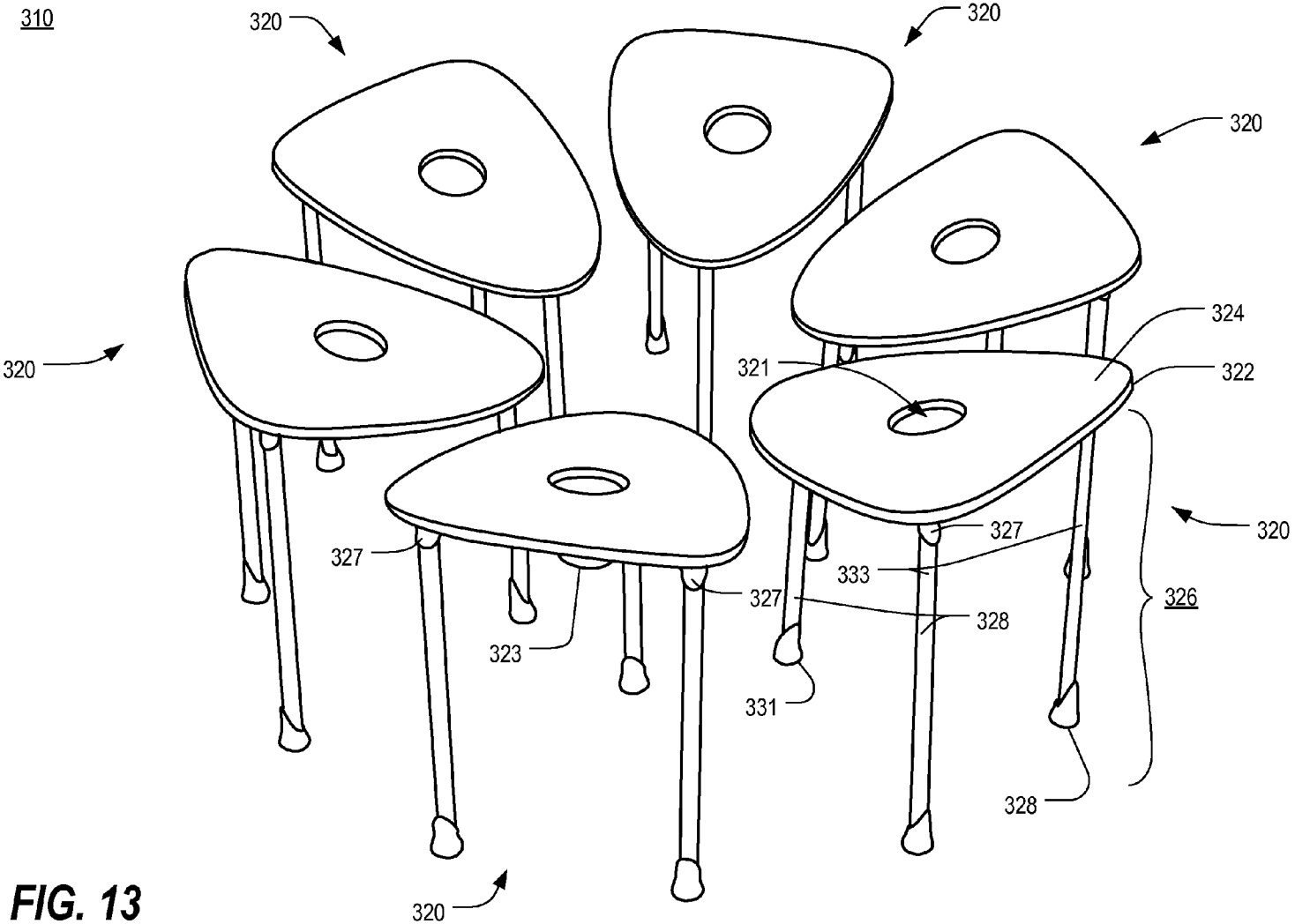
FIG. 13 is a top front perspective view of six table modules of a modular table tennis game set in accordance with a fourth preferred embodiment of the present invention.
Figure 14:
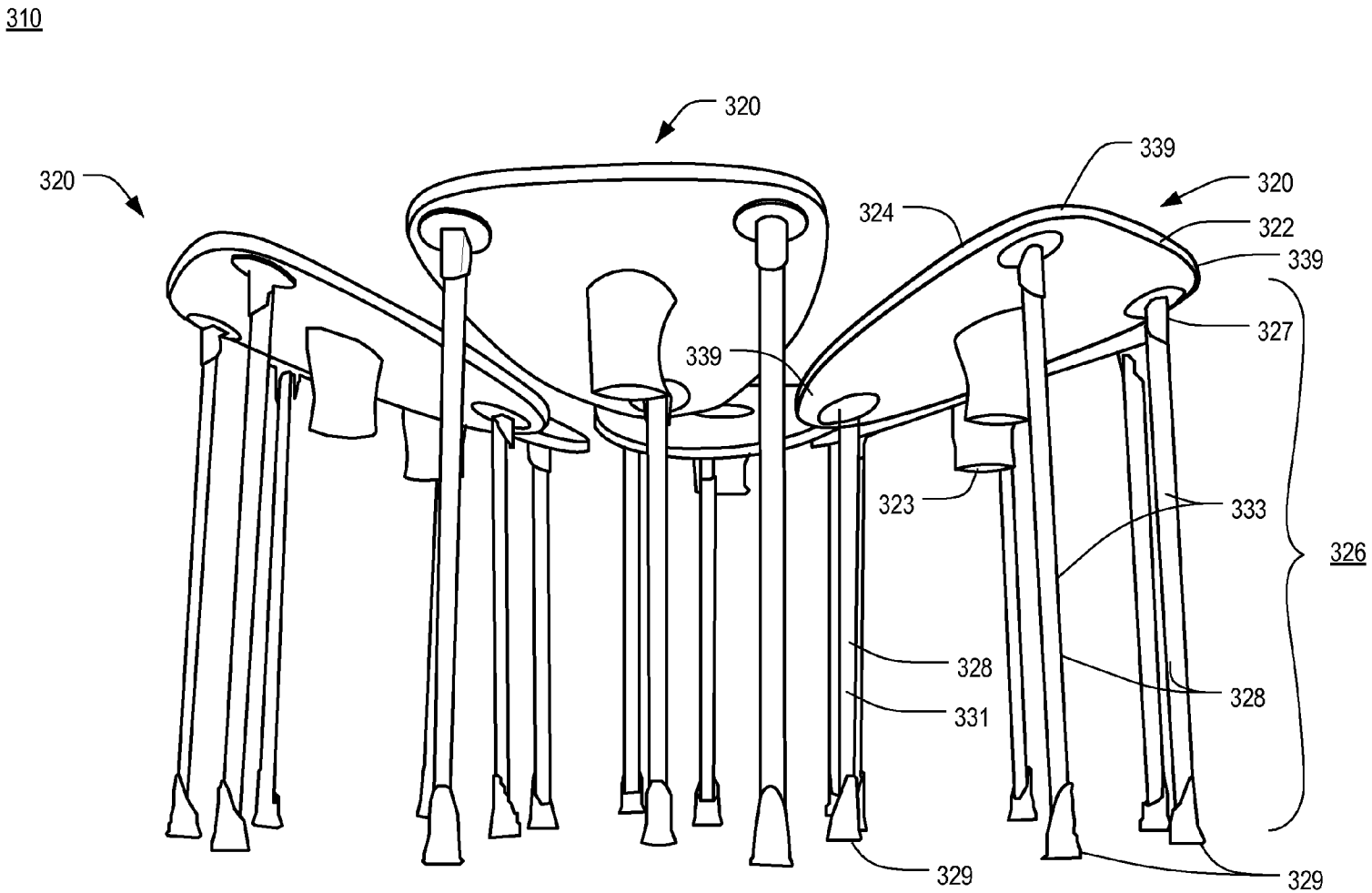
FIG. 14 is a bottom front perspective view of the six table modules of FIG. 13.

FIGS. 13 and 14 are a top front perspective view and a bottom front perspective view, respectively, of six table modules 320 of a modular table tennis game set 310 in accordance with a fourth preferred embodiment of the present invention. Each table module 320 includes a top member 322, preferably having a playing surface 324 of a composition conventionally used for table tennis playing surfaces supported by a three-leg support system 326. As with the table modules 220 of FIGS. 11 and 12, each top member 322 is generally wedge-shaped to facilitate one or more methods of play, with a front end of the top member 322 tapering to a curved nose and a rear end having two distinct comers. The three-leg support system 326 includes three fixed-length legs 328, each of which may be of generally conventional construction, arranged around the periphery to provide stable support for the top member 322. In particular, legs of two lengths are provided, with a shorter leg 331 disposed near the front end of the table module 320 and two longer legs 333 disposed near the rear comers 339 of the module 320.

FIGS. 13 and 14 illustrate several other variations relative to the table modules 220 of FIGS. 11 and 12. First, the dimensions vary, including the tilt angle (back to front) of each table module 320. Further, each top member 322 is penetrated by an opening 321 covered on the bottom side by a basket 323 that is supported from the underside of the top member 322. The opening 321 should be considerably larger than the diameter of the ball 14, but the specific dimensions may be selected according to the degree of difficulty desired for one or methods of play. Still further, each leg 328 includes a conventional latching pivot mechanism 327 to permit the leg 328 to be folded up against the underside of the top member 322 for storage or transport, and further includes a foot 329, made from rubber, plastic or the like in conventional manner, to protect the bottom end of the leg 328 from damage, to prevent damage to the floor or other surface on which the table module 320 is supported, to provide a more stable support for the table module 320, and the like. In at least some embodiments, the conventional latching pivot mechanism 327 is an adjustable mounting assembly having a first part fixed to the top of the leg and a second part fixed to the top member 322, with the second part being rotatable, relative to the first part, about at least one axis of rotation, and may be used to adjust the height of the top member.

Figure 15:
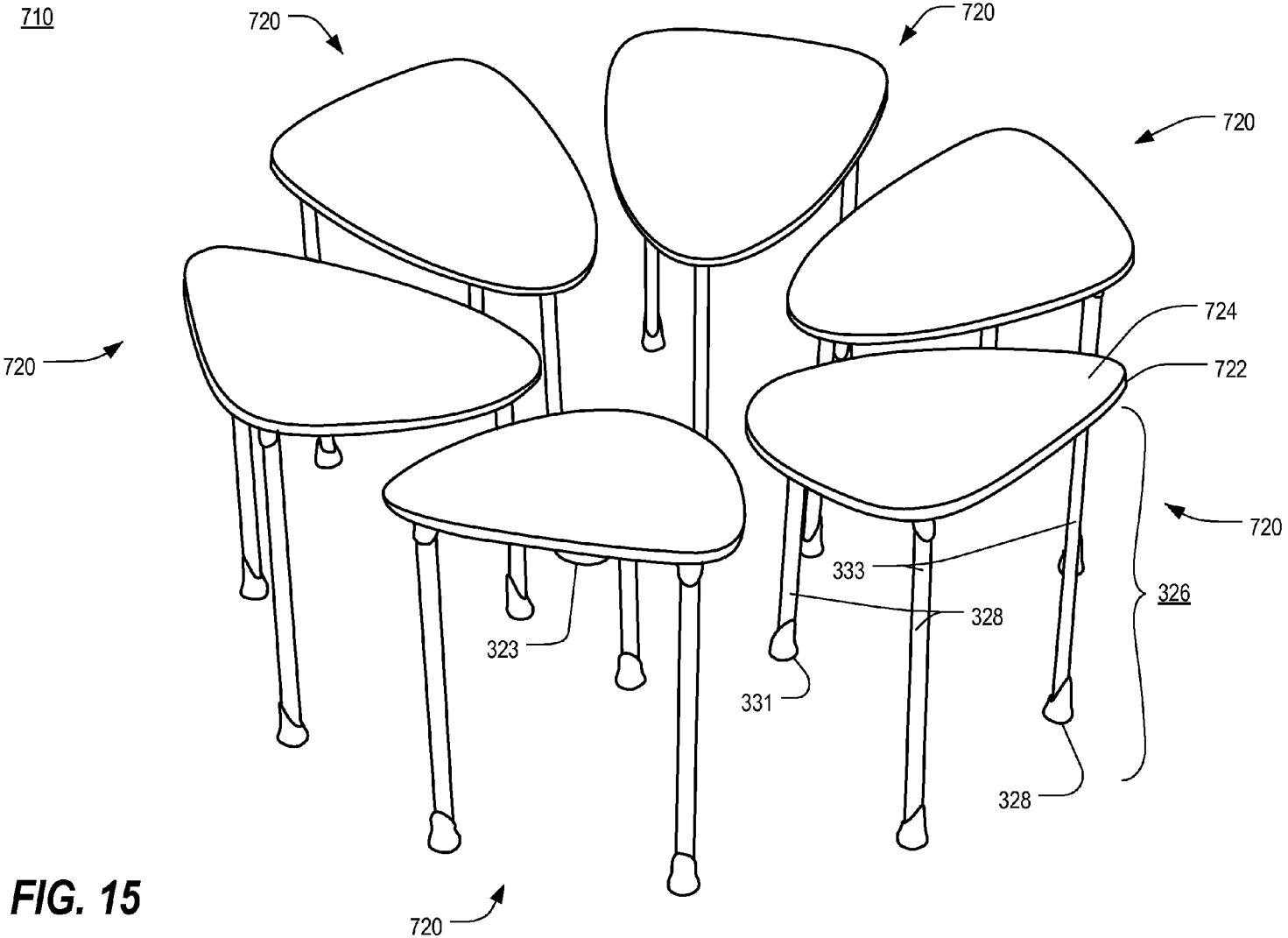
FIG. 15 is a top front perspective view of six table modules of a modular table tennis game set in accordance with a fifth preferred embodiment of the present invention.

FIG. 15 is a top front perspective view of six table modules 720 of a modular table tennis game set 710 in accordance with a fifth preferred embodiment of the present invention. The modules 720 are generally similar to those of FIG. 13, except that the top member 722 and playing surface 724 do not include any opening. Like the top member 322 of FIG. 13, the top member 722 of these modules 720 preferably includes a playing surface 324 of a composition conventionally used for table tennis playing surfaces, and each top member 722 is generally wedge-shaped to facilitate one or more methods of play, with a front end of the top member 722 tapering to a curved nose and a rear end having two distinct corners.

Figure 16:
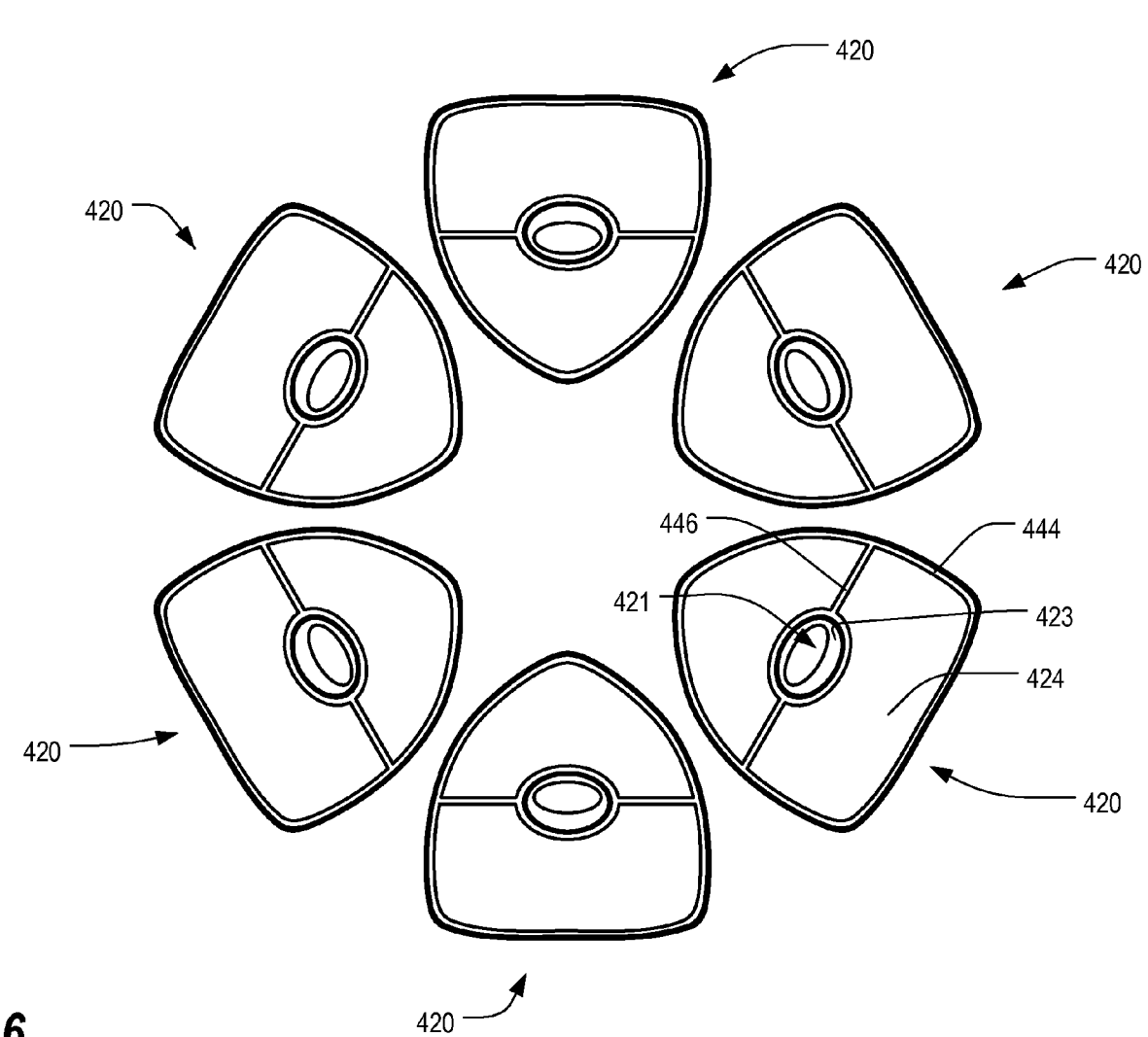
FIG. 16 is a top view of six table modules of a modular table tennis game set in accordance with a sixth preferred embodiment of the present invention.

FIG. 16 is a top view of six table modules 420 of a modular table tennis game set 410 in accordance with a sixth preferred embodiment of the present invention. Each table module 420 is generally similar to the table modules 320 of FIGS. 13 and 14 but includes striping 444,446 on the playing surface 424. A first stripe 444 extends around the periphery of the playing surface 424 to better visually define the edge of the surface 424, and a second stripe 446 extends straight across the body of the playing surface, intersecting the opening 421 on the way, to provide additional interest to one or more methods of play, some of which are described hereinbelow.

Figure 17:
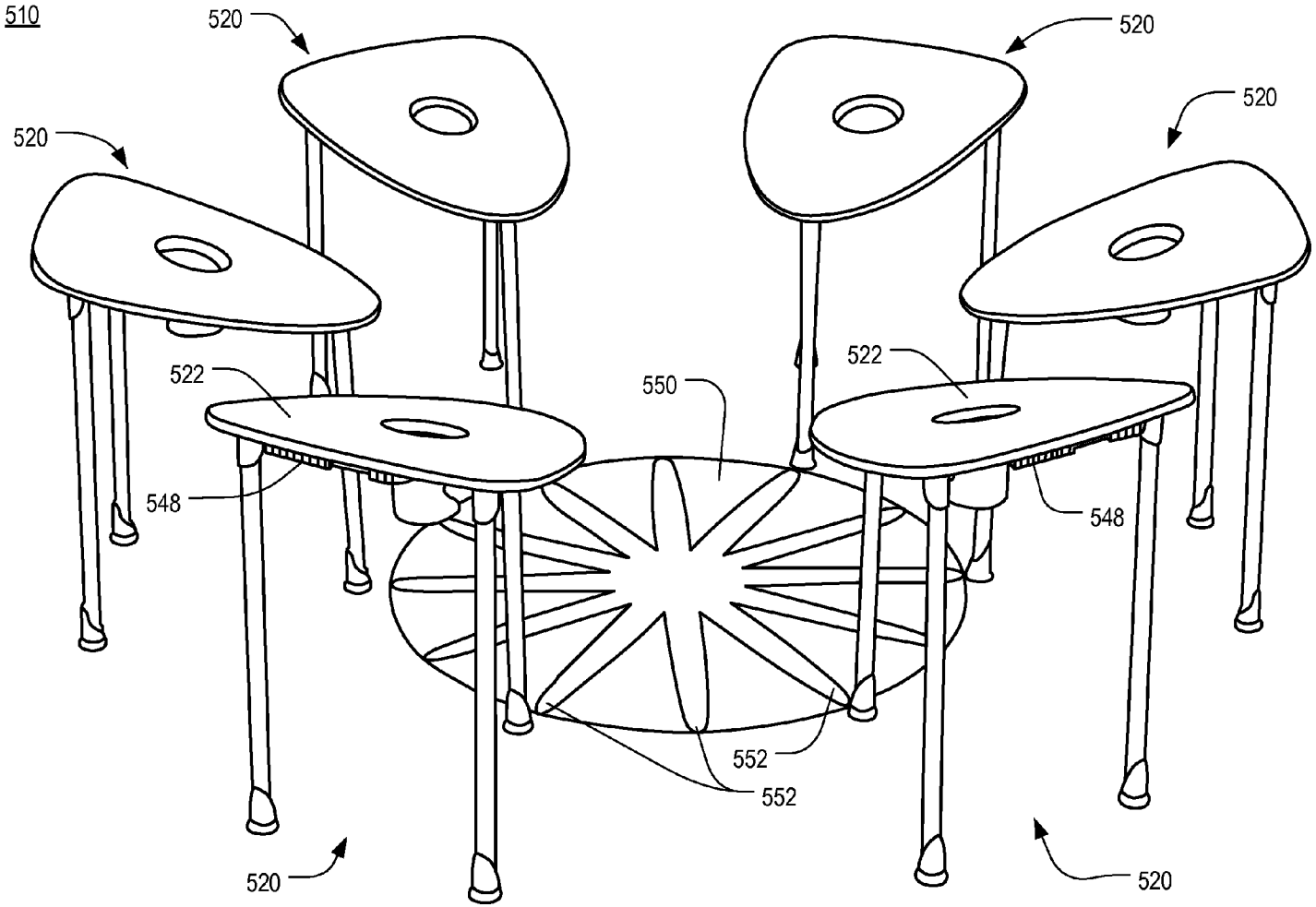
FIG. 17 is a top front perspective view of elements of a modular table tennis game set in accordance with a seventh preferred embodiment of the present invention.

FIG. 17 is a top front perspective view of elements of a modular table tennis game set 510 in accordance with a seventh preferred embodiment of the present invention. As shown therein, each table module 520 is similar to those of FIG. 16 but further includes a scoring device 548 near the rear end of a top member 522. Such a device disposed in this location makes it easy for a player to keep track of his or her score during a game played according to one or more methods, some of which are disclosed herein. The modular table tennis game set 510 of FIG. 17 also includes a center mat 550, which is provided to provide users with an indication of location and alignment of the table modules 520 relative to each other. More particularly, radii 552 extending from the center of the mat 550 show the alignment for up to twelve table modules 520 and can be used to define the spacing between modules 520 according to the number of modules 520 to be utilized. Furthermore, the periphery of the mat 550 provides one indication of the desired disposition of the front end of each table module 520; additional markings may be provided, each at a uniform distance from the center of the mat 550, for alternative dispositions. Such a mat 550 may likewise be incorporated into one or more of the other embodiments described and illustrated herein.

One or more methods of play are next described in view of the foregoing description and the illustrations accompanying them. Some of the descriptions of play make reference to FIGS. 18-20, which show various arrangements of table modules 620 of a modular table tennis game set 610 in accordance with a eighth preferred embodiment of the present invention.

First Method of Play

In a method of play in accordance with a first preferred method of the present invention, two table modules 20,120,220,320,420,520,620,720 each in accordance with one or more of the preferred embodiments of the present invention, are arranged to face each other, but separated by a desired distance. Such a distance may be established by official rules, provided in conjunction with the provision of the table modules, or by agreement between the players. Each player has his or her own table module 20,120,220,320,420,520,620,720 and paddle 12. No matter how many players participate in a given game or match, all table modules 20,120,220,320,420,520,620,720 are equally spaced apart from each other in a circular formation. In at least one embodiment, each player should position the nose, or narrower end, of his or her table module 20,120,220,320,420,520,620,720 a distance of 2.25 feet away from the circle's center. In at least one embodiment, a mat, such as the mat 550 of FIG. 17, is used to define the distance and proper location. The nose should also face the inside of the circle. During play, each player stands generally behind or beside his own table module 20,120,220,320,420,520,620,720 on the outside of the circle.

Figure 18:
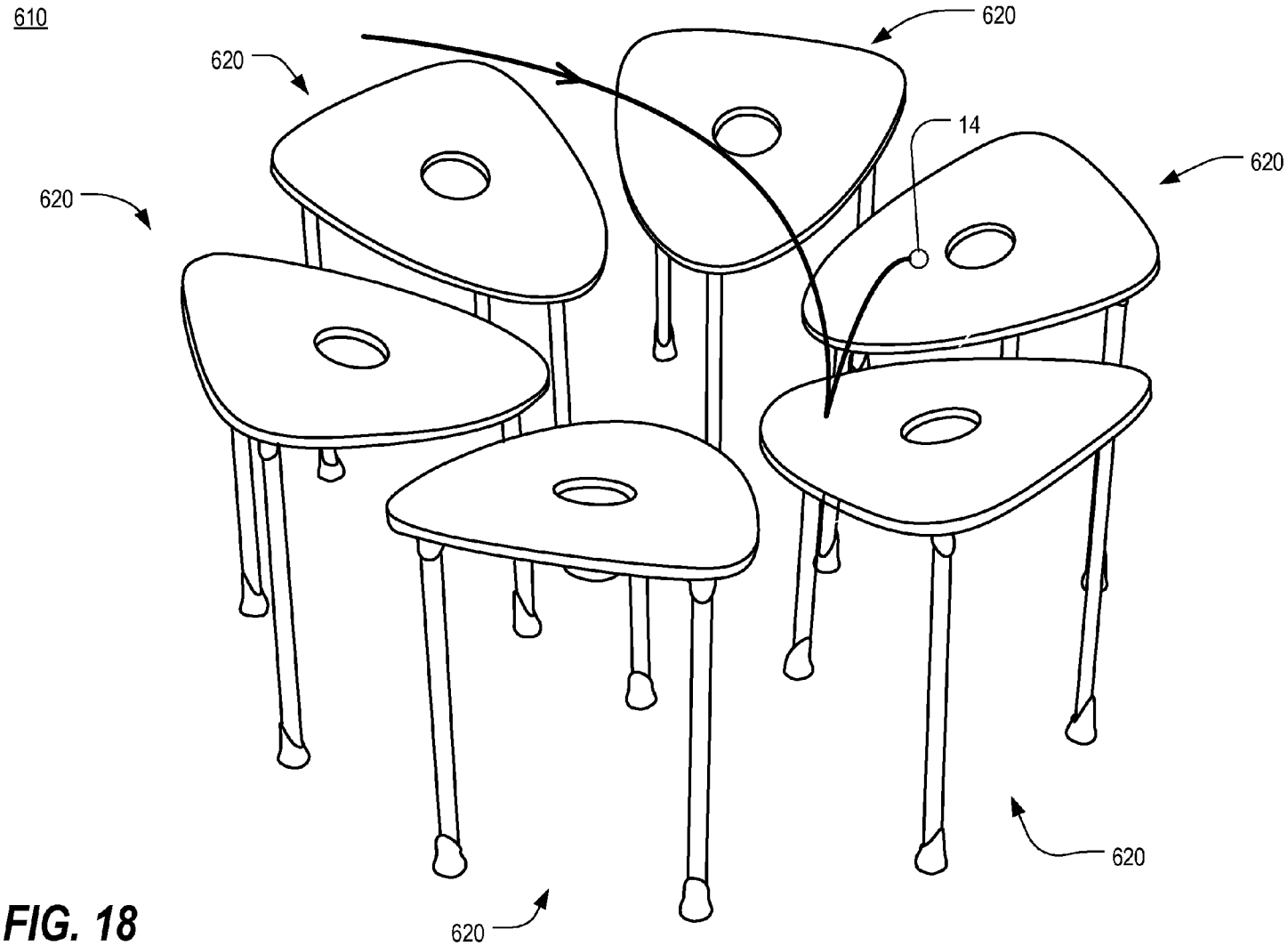
FIG. 18 is a top front perspective view of six table modules of a modular table tennis game set in accordance with an eighth preferred embodiment of the present invention.

A match may include one or more games. During each game, one player puts the ball 14 in play by serving it to the table module 20,120,220,320,420,520,620,720 of another player. An exemplary serve is schematically illustrated in FIG. 18, which is a top front perspective view of six table modules 620 of the modular table tennis game set 610. The first server may be chosen by any desired method. If provided, the center stripe 444 on the playing surface 424 of each table module 20,120,220,320,420,520,620 is defined as the service line. In at least one method of game play, players must always hit the ball 14 so that it lands above the service line 444 (in the area closest to the opposing player) of the opponent's playing surface 424. If the server misses the playing surface 424 entirely, he loses a point. If he hits the ball 14 and it lands below the service line 444 on the opponent's playing surface 424, he receives one more chance to successfully serve the ball 14 above the line 444.

In at least one method of game play, each player announces how many points he has before each new serve, starting with the player who is serving. In at least one method of game play, if five or more players are participating in a game, the server is not permitted to serve to the players directly to his right or left, but if four or fewer players are participating, then the server may serve to anyone in the game.

After the ball 14 is served, the receiving player attempts to strike the ball 14 in such a way as to cause it to land on another player's playing surface 424. In at least one method of game play, if the ball 14 ricochets off the edge of the playing surface 424 and flies upward and the receiving player misses the ball 14, the server gains a point; if the ball 14 flies downward (toward the floor, the ground or the like) and the receiving player misses it, it is deemed to be a "fault" and the server must deduct one point from his total score. In at least one method of game play, other than during the serve, there is no limitation as to which of the various opponent playing surfaces 424 the striking player aims for or on which opponent's playing surface 424 the ball 14 actually lands. However, in at least one method of game play, an interference rule is established such that a player cannot strike the ball 14 before it makes contact with his playing surface 424; it must bounce once before it is returned; it cannot double bounce; it must be returned by the player to whom the playing surface 424 belongs; and a player may not strike the ball 14 if it has already bounced on another player's playing surface 424. The penalty for interference is preferably set as the deduction of one point from the score of the player who violates the rule; scoring is further described below.

In at least one method of game play, the participating players take turns serving, with each turn defined as three serves (not including second chance serves, described above). When the server's turn is over, he or she passes the ball 14 to the player on his or her left (clockwise) for the next turn to serve.

With regard to scoring, each player is responsible for keeping track of his own points. All players begin with a predetermined number of points, with twelve points being preferred in at least one method of game play, and points are deducted from individual players' scores as they make errors. Players are eliminated from the game when their score drops to zero. The last player in the game wins. In at least one method of game play, a player must deduct a point from his total score when he does not successfully serve or return the ball (i.e. make contact with an opposing player's playing surface 24,124,224,324,424,525,624,724), when he scores on his own goal (defined as the combination of an opening and basket such as the opening 321 and basket 323 of FIG. 13) when attempting to serve, or when the ball hits the edge of his own opening during play and deflects off the playing surface 24,124,224,324,424,525,624,724. Furthermore, in at least one method of game play, a player must deduct three points when his goal is scored upon, wherein scoring on a goal is defined the ball 14 being struck, by any player, such that it passes completely through the opening in the player's top member and lands in his basket (for example, the opening 321, top member 322 and basket 323 shown in FIG. 13) without bouncing back out.

Figure 19:
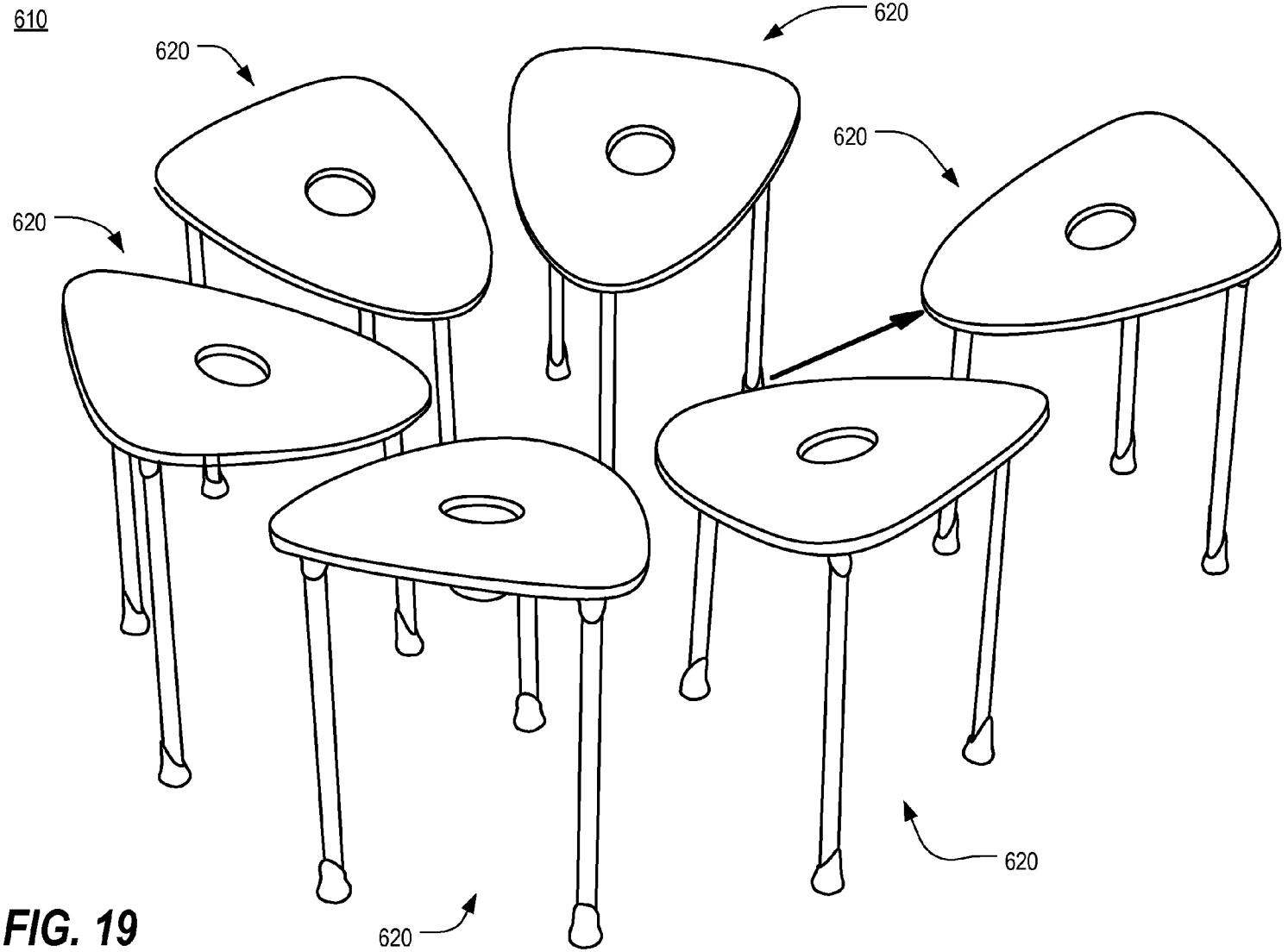
FIG. 19 is a top front perspective view of the six table modules of FIG. 18 with one of the modules being removed in accordance with a mode of play.
Figure 20:
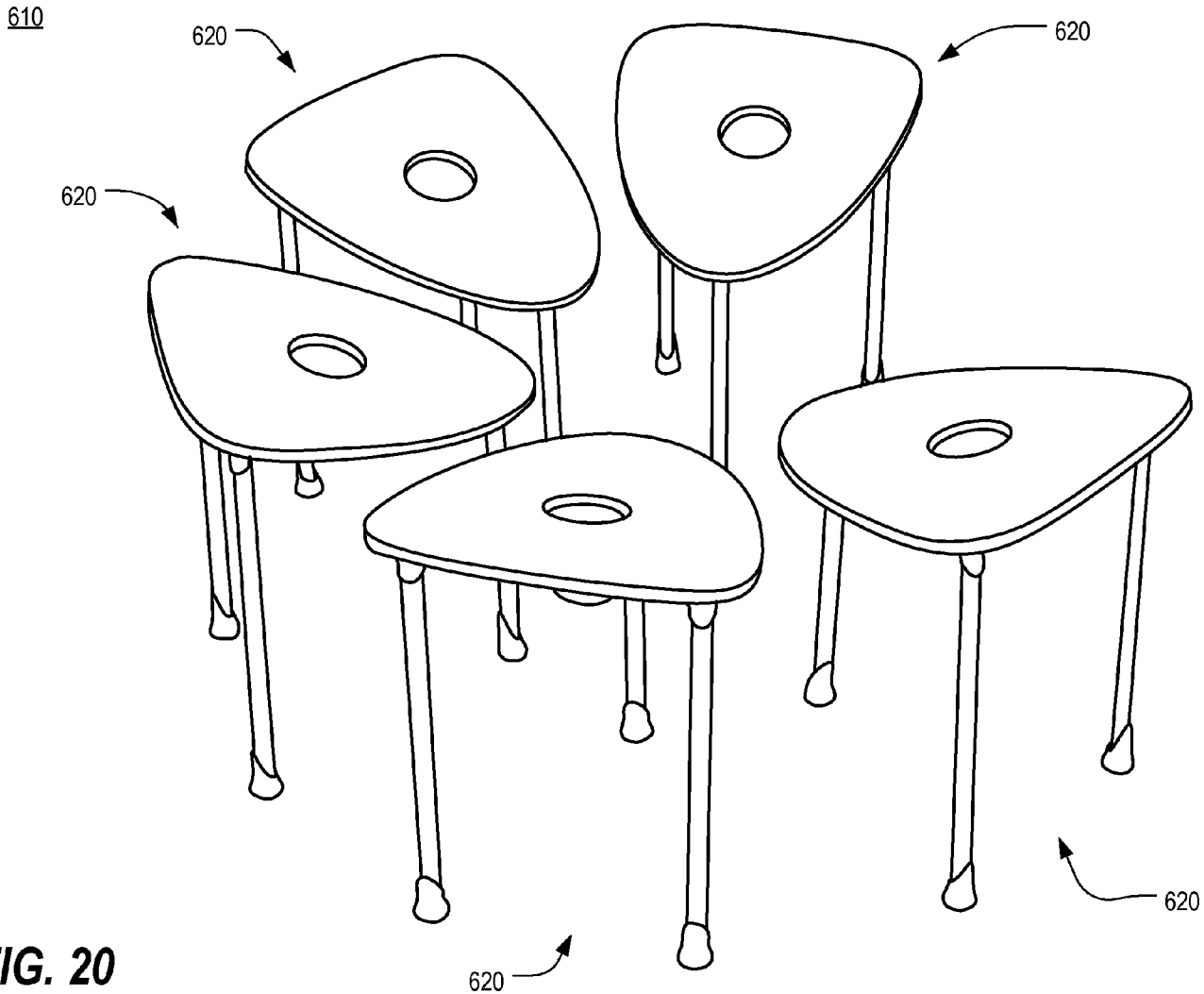
FIG. 20 is a top front perspective view of the five remaining table modules of FIG. 19.
Figure 21:
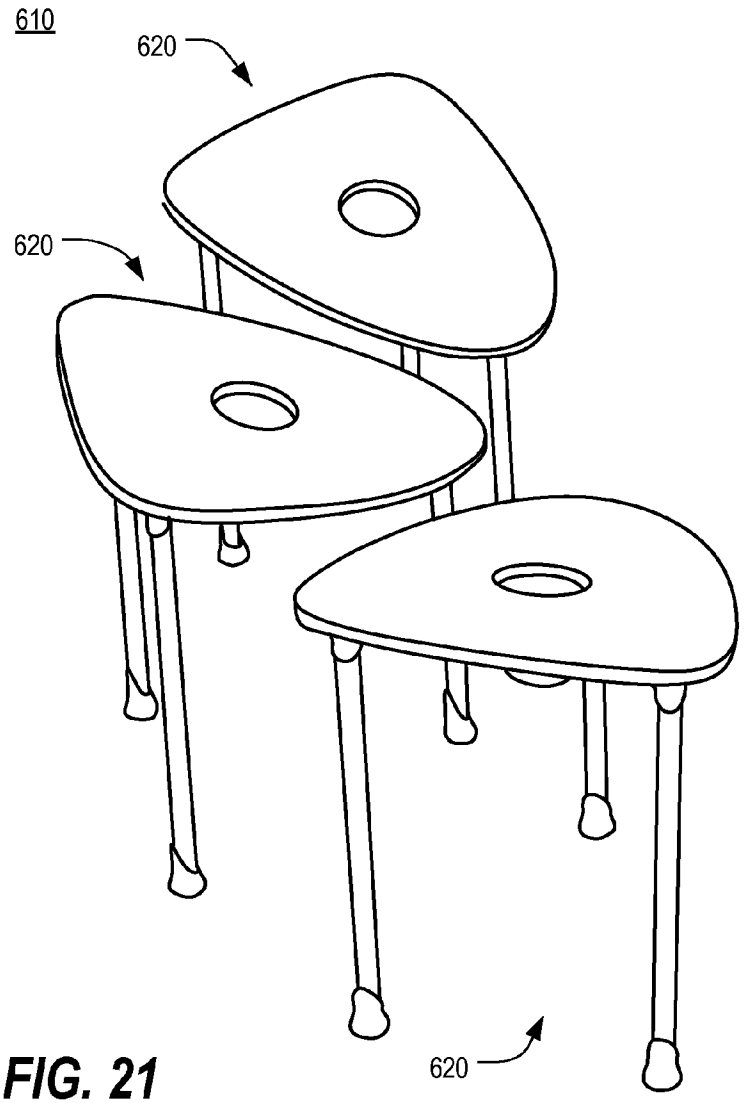
FIG. 21 is a top front perspective view of three remaining table modules from FIG. 20.

FIG. 19 is a top front perspective view of the six table modules 620 of FIG. 18 with one of the modules 620 being removed in accordance with a mode of play. In at least one method of game play, as players are eliminated, their table module 20,120,220,320,420,520,620,720 is removed but the other modules 20,120,220,320,420,520,620,720 remain in their location. FIG. 20 is a top front perspective view of the five remaining table modules 620 of FIG. 19 (i.e., after one of the table modules 620 has been removed), and FIG. 21 is a top front perspective view of three remaining table modules 620 from FIG. 20, illustrating an arrangement of the table modules 620 after three players have been eliminated and their modules 620 removed. In at least another method of game play, as players are eliminated, their table module 20,120,220,320,420,520,620,720 are removed and the remaining players must rearrange their table modules 20,120,220,320,420,520,620,720 to maintain the circular formation and make sure they are equally spaced from each other.

Second Method of Play

In a method of play in accordance with a second preferred method of the present invention, all of the rules and variations described above are used except for one further variation: scoring on an opponent's goal automatically eliminates the opponent (not the scorer) from the game.

Third Method of Play

In a method of play in accordance with a third preferred method of the present invention, only two players are involved and only two table modules 20,120,220,320,420,520,620,720 are utilized. A different set of rules are incorporated for a "rally" form of the game. To play, the two players' table modules 20,120,220,320,420,520,620,720 are arranged directly across from each other, approximately 4.5 feet apart. A mat, such as the mat 550 of FIG. 17, may be used to establish the proper distance. The object of the game is to be the first to score three points. In other words, unlike the first and second methods of play described above, each player does not begin with twelve points and subtract from their score for errors committed. In the third method of play, a player can only score by hitting the ball 14 into the opposing player's goal. Additionally, the server does not receive three automatic chances to serve the ball 14, but must earn his right to serve.

Play begins by choosing one player to begin serving. The server must hit the ball 14 above the service line 444 of the opposing player's playing surface for the serve to count. The server has two attempts to successfully serve the ball before losing his turn. The players then alternate shots in somewhat similar manner to traditional ping-pong, but a player's failure to return the ball 14 successfully does not score a point but instead merely gives his opponent the right to serve, which in at least some methods of game play is a significant advantage.

In at least one method of game play, hitting the ball 14 into the opposing player's goal not only scores a point but gives the player the right to serve. In at least one method of game play, if the server hits the ball 14 such that it hits the edge of the opponent's goal and then bounces off the playing surface 424, he may serve again. In at least one method of game play, serving the ball 14 directly into the opponent's goal counts as an automatic point.

Fourth Method of Play

Figure 22:
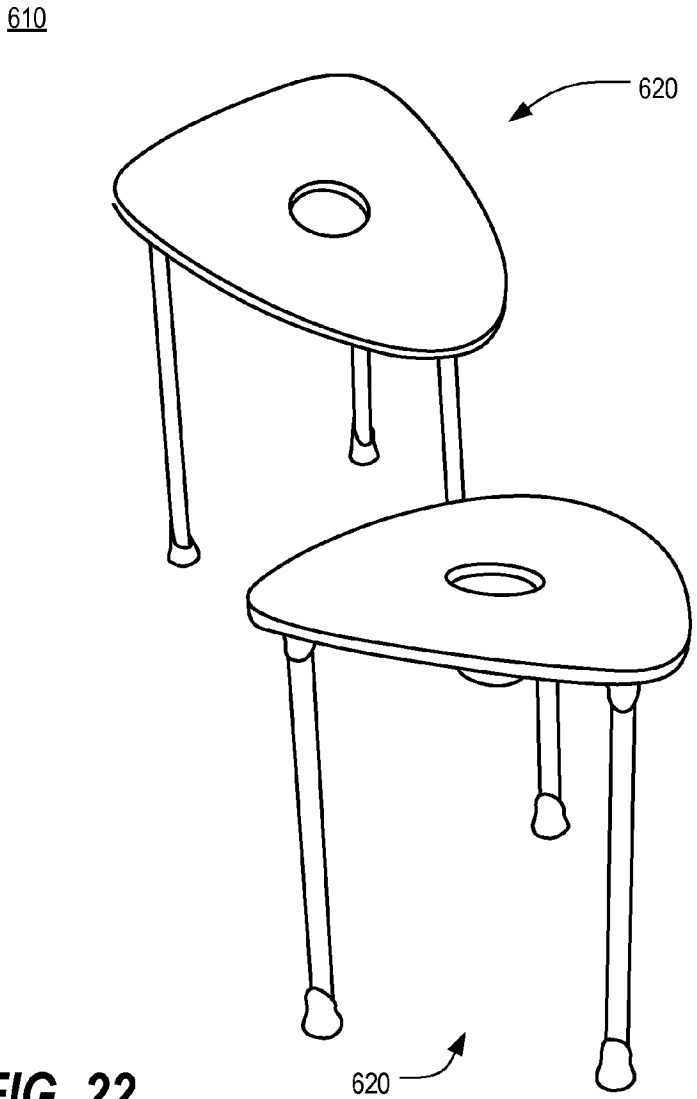
FIG. 22 is a top front perspective view of two remaining table modules from FIG. 21.

In a fourth method of play in accordance with a fourth preferred method of the present invention, one of the first two methods is modified by switching to rally play, as described with regard to the third method of play, when only two players remain in the game. FIG. 22 is a top front perspective view of two remaining table modules 620 from FIG. 21, wherein the two remaining players use rally play to determine a final winner. All rules of either the first or second method of play apply before that time, and all rules of the third method of play apply during rally play.

Based on the foregoing information, it is readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

What is claimed is:

1. A modular table tennis game set, comprising:

(a) a plurality of paddles;

(b) a table tennis ball; and (c) a plurality of table modules, each including:

(i) a top member having a playing surface that is tilted at a substantially non-vertical angle relative to horizontal, and (ii) a support system on which the top member is mounted;

(d) wherein each of the plurality of table modules is separated from at least one other table module by a substantial distance; and (e) wherein the top member of a first of the plurality of table modules is tilted away from a second of the plurality of table modules.

2. A modular table tennis game set, comprising:

(a) a plurality of paddles;

(b) a table tennis ball; and (c) a plurality of table modules, each including:

(i) a top member having a playing surface that is tilted at a substantially non-vertical angle relative to horizontal, and (ii) a support system on which the top member is mounted;

(d) wherein each of the plurality of table modules is separated from at least one other table module by a distance at least as great as a substantial fraction of the length or width of the top member.

3. The modular table tennis game set of claim 2, wherein the distance is at least 2.25 feet.

4. A modular table tennis game set, comprising:

(a) a plurality of paddles;

(b) a table tennis ball; and (c) a plurality of table modules, each including:

(i) a top member having a playing surface that is tilted at a substantially non-vertical angle relative to horizontal, and (ii) a support system on which the top member is mounted;

(d) wherein each of the plurality of table modules is separated from at least one other table module by a substantial distance; and (e) wherein the support system includes an adjustable-height tripod.

5. The modular table tennis game set of claim 4, wherein the tripod is mounted to the top member at a location substantially adjacent the center of a bottom surface of the top member.

6. The modular table tennis game set of claim 4, wherein the top member is mounted to the tripod via an adjustable mounting assembly having a first part connected to a top of the tripod and a second part connected to the top member, wherein the second part is rotatable, relative to the first part, about an axis of rotation.

7. A modular table tennis game set, comprising:

(a) a plurality of paddles;

(b) a table tennis ball; and (c) a plurality of table modules, each including:

(i) a top member having a playing surface that is tilted at a substantially non-vertical angle relative to horizontal, and (ii) a support system on which the top member is mounted, the support system including a plurality of legs of adjustable length;

(d) wherein each of the plurality of table modules is separated from at least one other table module by a substantial distance; and (e) wherein the length of a first of the plurality of legs is different than the length of a second of the plurality of legs, thereby causing the top member to be tilted.

8. A modular table tennis game set, comprising:

(a) a plurality of paddles;

(b) a table tennis ball; and (c) a plurality of table modules, each including:

(i) a top member having a playing surface that is tilted at a substantially non-vertical angle relative to horizontal, and (ii) a support system on which the top member is mounted;

(d) wherein each of the plurality of table modules is separated from at least one other table module by a substantial distance; and (e) wherein the playing surface of each top member has an opening, penetrating therethrough, with a diameter that is substantially greater than the diameter of the table tennis ball.

9. A modular table tennis game set, comprising:

(a) a plurality of paddles;

(b) a table tennis ball; and (c) a plurality of table modules, each including:

(i) a top member having a playing surface, (ii) at least one support leg adapted to provide freestanding support for the top member, and (iii) an adjustable mounting assembly, having a first part and a second part, connecting the top member to the at least one support leg, the second part being coupled to the first part such that the second part is rotatable, relative to the first part, about an axis of rotation.

10. The modular table tennis game set of claim 9, wherein each of the plurality of table modules is separated from at least one other table module by a substantial distance.

11. The modular table tennis game set of claim 10, wherein the distance is at least as great as a substantial fraction of the length or width of the top member.

12. The modular table tennis game set of claim 9, wherein the at least one support leg provides an adjustable height for at least a portion of the top member.

13. The modular table tennis game set of claim 12, wherein the at least one support leg forms an adjustable-height tripod.

14. The modular table tennis game set of claim 13, wherein the tripod is mounted to the top member at a location substantially adjacent the center of a bottom surface of the top member.

15. The modular table tennis game set of claim 12, wherein the at least one support leg includes a plurality of legs of adjustable length.

16. The modular table tennis game set of claim 15, wherein the top member is mounted to the legs at substantially separated locations on the bottom surface of the top member.

17. The modular table tennis game set of claim 15, wherein the plurality of legs includes exactly three legs.

18. The modular table tennis game set of claim 15, wherein the top member is adapted to be tilted by adjusting the length of a first of the plurality of legs to be different than the length of a second of the plurality of legs.

19. The modular table tennis game set of claim 9, wherein the top member of at least one table module has a playing surface that is tilted at a substantially non-vertical angle relative to horizontal.

20. The modular table tennis game set of claim 8, wherein the playing surface of each top member has an opening, penetrating therethrough, with a diameter that is substantially greater than the diameter of the table tennis ball.

* * * * *